US005667960A

United States Patent [19]

Usagawa et al.

[11] Patent Number: 5,667,960

[45] Date of Patent: Sep. 16, 1997

[54] METHOD FOR HARDENING GELATIN AND SILVER HALIDE PHOTOGRAPHIC LIGHT SENSITIVE MATERIALS EMPLOYING THE METHOD

[75] Inventors: Yasushi Usagawa; Masato Nishizeki, both of Tokyo, Japan

[73] Assignee: Konica Corporation, Tokyo, Japan

[21] Appl. No.: 671,137

[22] Filed: Jun. 27, 1996

[30] Foreign Application Priority Data

Jul. 7, 1995 [JP] Japan ..... 7-172300

[51] Int. Cl.[6] ..... G03C 1/30

[52] U.S. Cl. ..... 430/622; 430/621; 430/623; 430/640; 430/642

[58] Field of Search ..... 430/622, 621, 430/631, 640, 642, 630, 623; 106/125; 252/182.17; 530/354

[56] References Cited

U.S. PATENT DOCUMENTS 5,411,856 5/1995 Riecke et al. ..... 430/622

FOREIGN PATENT DOCUMENTS 1097116 12/1967 United Kingdom .
1119306 7/1968 United Kingdom .

*Primary Examiner*—Thorl Chea
*Attorney, Agent, or Firm*—Frishauf, Holtz, Goodman, Langer & Chick, P.C.

[57] ABSTRACT

A method for hardening gelatin comprises the step of mixing gelatin with a compound represented by the following formula (I), (II) or (III):

formula (I)

formula (II)

formula (III)

$$(CH_2{=}CH{-}SO_2\rangle_l J{\leftarrow}C{\equiv}N)_m$$

wherein $R_1$ and $R_2$ independently represent a hydrogen atom, an alkyl group, an aryl group or a heterocyclic group or $R_1$ and $R_2$ combine with each other to form a nitrogen-containing heterocyclic ring; J represents an organic group; l represents an integer of 2 to 5; and m represents an integer of 1 to 5.

10 Claims, No Drawings

METHOD FOR HARDENING GELATIN AND SILVER HALIDE PHOTOGRAPHIC LIGHT SENSITIVE MATERIALS EMPLOYING THE METHOD

FIELD OF THE INVENTION

The present invention relates to a method for hardening gelatin and a silver halide photographic light-sensitive material using the method, and more particularly to a method for hardening gelatin with an improved hardener and a silver halide photographic light-sensitive material using the method.

BACKGROUND OF THE INVENTION

Gelatin is used as a binder of many silver halide photographic light-sensitive material. Generally, a silver halide photographic light-sensitive material (hereinafter referred to as simply light-sensitive material) has a silver halide emulsion layer, an intermediate layer, a protective layer, a filter layer, a subbing layer, an anti-halation layer, a UV absorbing layer, an anti-static layer or a backing layer on a support such as glass, paper, or synthetic resin film.

These various photographic constitution layers contain gelatin as a main component The photographic constitution layers, which are obtained by coating an aqueous solution containing a hydrophilic polymer and/or a water-dispersible polymer on a support, have a poor mechanical strength. For example, a gelatin membrane has lower melting point and extremely swells in water. A latex membrane has disadvantages in that its adhesion to a support is poor and it is likely to exfoliate.

It is well known that a compound called "hardener" is added to photographic structural layers to enhance mechanical strength thereof. For example, organic hardeners including aldehyde compounds such as formaldehyde and glutaric aldehyde, compounds having reactive halogen described in U.S. Pat. Nos. 2,732,303, 3,288,775, 3,951,940, British Patent Nos. 974,723 and 1,167,207, ketone compounds such as diacetyl and cyclopentadione, bis(2-chloroethyl)urea, 2-hydroxy-4,6-dichloro-1,3,5-triazine, divinylsulfone, 5-acetyl-1,3-diacroylhexahydro-1,3,5-triazine, compounds having a reactive olefin as described in U.S. Pat. Nos. 3,232,763 and 3,635,718 and British Patent No. 994,809, vinylsulfonyl compounds described in U.S. Pat. Nos. 3,539,644, and 3,642,486, Japanese Publication Nos. 49-13563/1974, 53-47271/1978 and 56-48860/1981, and Japanese Patent O.P.I. Publication Nos. 53-57257/1978, 61-128240/1986, 62-4275/1987, 63-53541/1988 and 63-264572/1988, N-hydroxymethylphthalimide, N-methylol compounds described in U.S. Pat. Nos. 2,732,316 and 2,586,168, isocyanates described in U.S. Pat. No. 3,103,437, azilidine compounds described in U.S. Pat. Nos. 2,983,611 and 3,017,280, acid derivatives described in U.S. Pat. Nos. 2,725,294 and 2,725,295, carbodiimides in U.S. Pat. No. 3,100,704, epoxy compounds described in U.S. Pat. No. 3,091,537, isooxazoles described in U.S. Pat. Nos. 3,321,313 and 3,543,292, halogencarboxylic aldehydes such as mucochlorolic acid, dioxane derivatives such as dihydroxydioxane and dichlorodioxane or inorganic hardeners including alum chromate, zirconium sulfate and chromium trichloride are cited.

However, the above-mentioned conventional hardeners, when used for a photographic light-sensitive material, have some shortcomings in that hardening effect is insufficient, there is long-termed change of the degree of hardness called after-hardening due to slow hardening effect on gelatin, an adverse affect (increase of fogging, reduction of sensitivity or maximum density or contrast reduction) on the performance of photographic light-sensitive material, loss of hardening effect due to other co-existing photographic additives and reduction of the effects of other photographic additives (for example, a coupler in coupler-in-emulsion type color emulsion).

As a hardener wherein hardening reaction on gelatin is relatively speedy and after-hardening is small, compounds having a dihydroquinoline skeleton described in Japanese Patent O.P.I. Publication No. 50-38540/1975, N-carbamoyl pyridinium salts described in Japanese Patent O.P.I. Publication Nos. 51-59625/1976, 62-262854/1987, 62-264044/1987 and 63-184741/1988, acylimidazols described in Japanese Patent Publication No. 55-38655/1980, compounds having 2 or more N-acyloxyimino groups in a molecule described in Japanese Patent Publication No. 53-22089/1978, compounds having an N-sulfonyloxyimide group described in Japanese Patent OPI Publication No. 52-93470/1977, compounds having a phosphor-halogen linkage described in Japanese Patent OPI Publication No. 58-113929/1983, and chloroformamidium described in Japanese Patent OPI Publication Nos. 60-225148/1985, 61-240236/1986 and 63-41580/1988 are known.

Among the above compounds, the N-carbamoylpyridium salts have high hardening speed and reduced after-hardening degree. However, an amine, which is a by-product produced after hardening reaction, has an adverse effect on light sensitive materials to the degree which is not disregarded.

To the contrary, the vinylsulfonyl compounds described above, which do not produce the by-product, are known. These compounds have reduced adverse effects on the light sensitive materials, but have shortcomings in lower hardening speed and low water solubility.

U.S. Pat. No. 5,411,856 discloses vinylsulfonyl compounds which these shortcomings are improved, but hardening speed is not yet satisfactory. Accordingly, a hardener which has higher hardening speed has been sought.

SUMMARY OF THE INVENTION

A first object of the present invention is to provide a novel gelatin hardener with high hardening speed and reduced after-hardening and a method of hardening gelatin. A second object of the present invention is to provide a silver halide photographic light sensitive material wherein a gelatin layer is hardened with the novel hardener with high hardening speed and reduced after-hardening without an adverse effect on the photographic properties.

DETAILED DESCRIPTION OF THE INVENTION

The above-mentioned object on the invention can be attained the following constitution:

(1) A method for hardening gelatin employing at least one of compounds represented by the following formulae (I), (II) and (III):

formula (I)

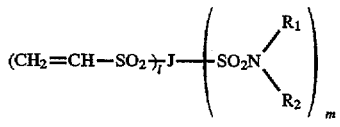

-continued

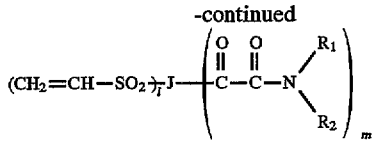

formula (II)

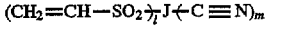

formula (III)

wherein $R_1$ and $R_2$ independently represent a hydrogen atom, an alkyl group, an aryl group or a heterocyclic group or $R_1$ and $R_2$ may combine with each other to form a nitrogen-containing heterocyclic ring; J represents an organic group; 1 represents an integer of 2 to 5; and m represents an integer of 1 to 5, (2) the method for hardening gelatin of (1) above, wherein said J represents an alkylene group which may have another organic group in the alkylene chain, (3) A method for hardening gelatin employing at least one of compounds represented by the following formulae (IV), (V) and (VI):

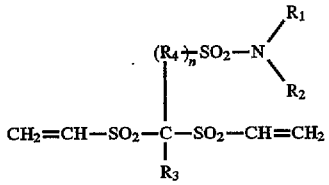

formula (IV)

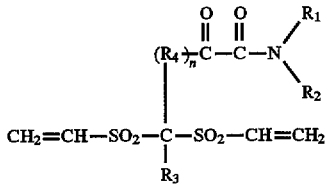

formula (V)

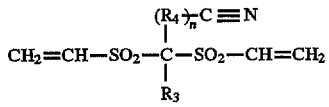

formula (VI)

wherein $R_1$ and $R_2$ independently represent a hydrogen atom, an alkyl group, an aryl group or a heterocyclic group or $R_1$ and $R_2$ may combine with each other to form a nitrogen-containing heterocyclic ring; $R_3$ represents a hydrogen atom or a substituent; $R_4$ represents an alkylene group; and n represents an integer of 0 or 1, (4) A silver halide photographic light sensitive material comprising a support and provided thereon, at least one hydrophilic colloid layer, wherein said at least one hydrophilic colloid layer is hardened with at least one of compounds represented by the above formulae (I), (II) and (III), (5) The method for hardening gelatin of (4) above, wherein said J represents an alkylene group which may have another organic group in the alkylene chain, or (6) A silver halide photographic light sensitive material comprising a support and provided thereon, at least one hydrophilic colloid layer, wherein said at least one hydrophilic colloid layer is hardened with at least one of compounds represented by the above formulae (IV), (V) and (VI).

The invention will be detailed below.

The compound of the invention represented by formula (I), (II) or (III) will be explained below.

In formula (I), (II) or (III), $R_1$ and $R_2$ independently represent a hydrogen atom, a straight-chained or brached alkyl group (for example, methyl, ethyl, i-propyl or cyclohexyl), an aryl group (for example, phenyl) or a heterocyclic group (for example, morpholino or pyridyl) or $R_1$ and $R_2$ may combine with each other to form a nitrogen-containing heterocyclic ring (for example, morpholino or piperino). The group other than a hydrogen atom represented by $R_1$ and $R_2$ may have a substituent. The substituent represents the same as those in $R^3$ denoted later.

J represents an organic group such as alkylene, phenylene or heterocyclic, and the group may have a substituent.

The substituent represents the same as those of $R_3$ denoted later. J preferably represents an alkylene group or an alkylene group having another organic divalent group in the alkylene main chain. The alkylene group having another organic divalent group is an alkylene group having, in the alkylene main chain, at least one of —O—, —S—, —(C=O)—, —$SO_2$—, —(C=O)NR— and —NR— in which R represents hydrogen or alkyl.

1 represents 2 to 5, preferably 2 to 4, and more preferably 2. m represents 1 to 5, preferably 1 to 4, and more preferably 1 or 2.

The compound of the invention represented by formula (IV), (V) or (VI) will be explained below.

In formula (IV), (V) or (VI), $R_1$ and $R_2$ represent the same as $R_1$ and $R_1$ denoted above in formula (I), (II) or (III).

$R_3$ represents a hydrogen atom or a substituent, the substituent includes the following:

an alkyl group (for example, methyl, ethyl, propyl,isopropyl, tert-butyl, pentyl, cyclopentyl, hexyl or cyclohexyl); an alkenyl group (for example, vinyl or allyl); an alkinyl group (for example, propagyl); an aryl group (for example, phenyl); a heterocyclic ring group (for example, pyridyl, thiazolyl, oxazolyl, imidazolyl, furyl, pyrrolyl, pirazinyl, pyrimidyo, pyridazinyl, selenazolyl, sulforanyl, piprdidinyl, pyrazolyl or tetrazolyl); a halogen atom (for example, a chlorine, bromine iodine or fluorine atom); an alkoxy group (for example, methoxy, ethoxy, propyloxy, pentyloxy, cyclopentyloxy, hexyloxy or cyclohexyloxy); an aryloxy group (for example, phenoxy); an alkoxycarbonyl group (for example, methyloxycarbonyl, ethyloxycarbonyl or butyloxycarbonyl); an aryloxycarbonyl group (for example, phenoxycarbonyl); a sulfonylamino group (for example, methylsulfonylamino, ethylsulfonylamino, butylsulfonylamino, hexylsulfonylamino, cyclohexylsulfonylamino or phenylsulfonylamino); a sulfamoyl group (for example, aminosulfonyl, methylaminosulfonyl, dimethylaminosulfonyl, butylaminosulfonyl, hexylaminosulfonyl, cyclohexylaminosulfonyl, phenylaminosulfonyl or 2-pyridylaminosulfonyl); a ureido group (for example, methylureido, ethylureido, penylureido, hexylureido, cyclohexylureido, phenylureido or 2-pyridylureido); an acyl group (for example, an acetyl, ethylcarbonyl, propylcarbonyl, pentylcarbonyl, cyclohexylcarbonyl, phenylcarbonyl or pyridylcarbonyl; a carbamoyl group (for example, aminocarbonyl, methylaminocarbonyl, dimethylaminocarbonyl, propylaminocarbonyl, pentylaminocarbonyl, cyclohexylaminocarbonyl, phenylaminocarbonyl or 2-pyridylaminocarbonyl); an amide group (for example, methylcarbonylamino, ethylcarbonylamino, propylcarbonylamino, pentylcarbonylamino or phenylcarbonylamino); a sulfonyl group (for example, methylsulfonyl, ethylsulfonyl, butylsulfonyl, cyclohexylsulfonyl, phenylsulfonyl or 2-pyridylsulfonyl group); an amino group (for example, amino, ethylamino, dimethylamino, butylamino, cyclopentylamino, anilino or 2-pyridylamino); a cyano group; a nitro group; a sulfo group; a carboxy group; a hydroxy group or an oxamoyl group.

The substituent represented by $R_3$ is preferably an alkyl group, an aryl group, a heterocyclic group, a carboxy group, an alkoxycarbonyl group, aryloxycarbonyl group, a carbamoyl group, a sulfamoyl group, a cyano group, an oxamoyl group, a hydroxy group, an alkoxy group, an acyl group, a sulfo group or a halogen atom.

The substituent represented by $R_4$ represents an alkylene group such as methylene, ethylene, trimethylene, tetramethylene or propylene, each of which may have a substituent.

The substituent of the group other than a hydrogen atom represented by $R_1$ and $R_2$, the organic group represented by J or the alkylene group represented by $R_4$ is the same as that denoted above in $R_3$.

The exemplified compound of a compound represented by formula (I), (II) or (III) in the invention will be shown below, but the invention is not limited thereto.

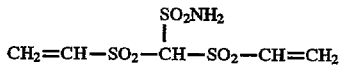
I-1

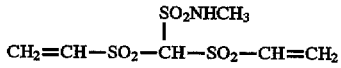
I-2

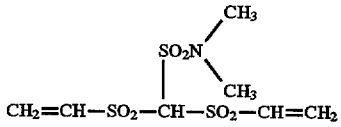
I-3

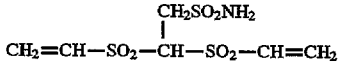
I-4

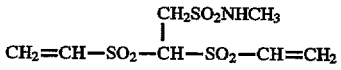
I-5

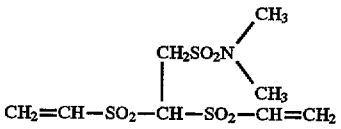
I-6

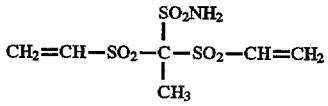
I-7

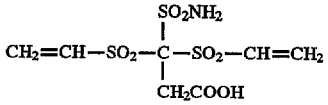
I-8

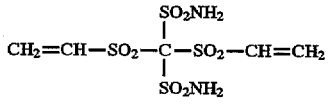
I-9

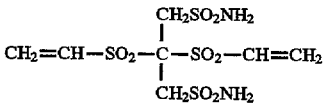
I-10

-continued

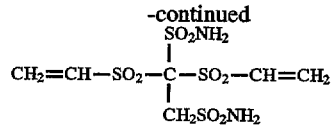
I-11

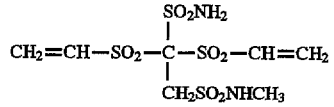
I-12

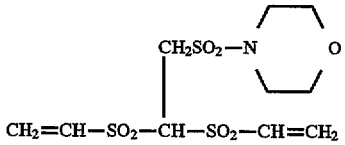
I-13

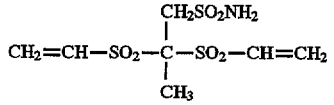
I-14

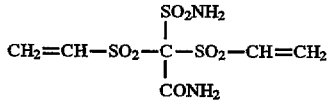
I-15

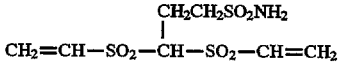
I-16

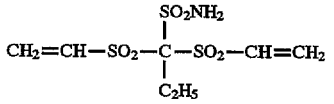
I-17

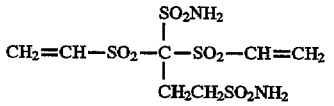
I-18

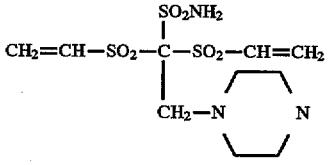
I-19

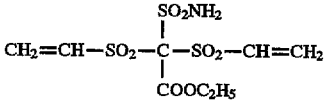
I-20

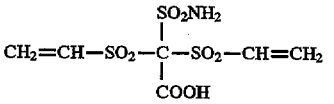
I-21

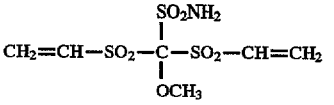
I-22

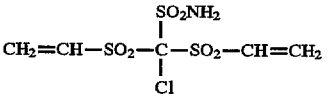
I-23

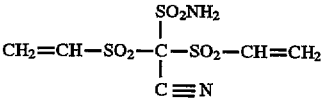
I-24

-continued
I-25
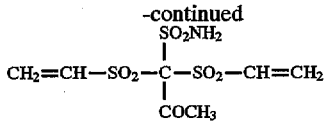
I-26
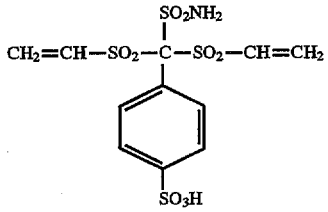
I-27
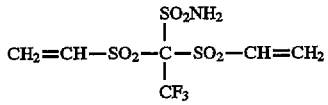
I-28
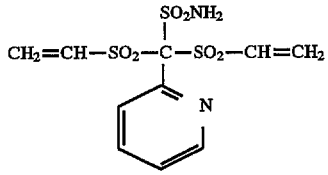
I-29
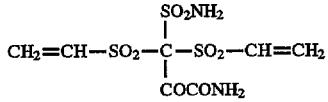
I-30
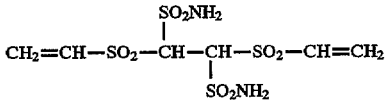
I-31
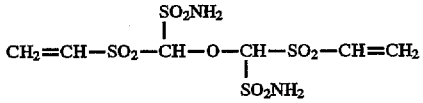
I-32
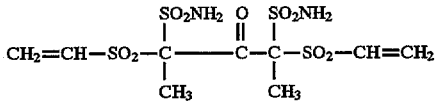
I-33
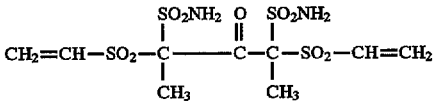
I-34
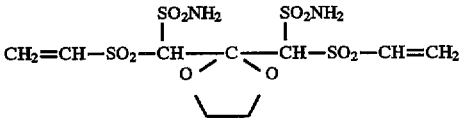
I-35
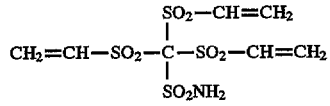
I-36
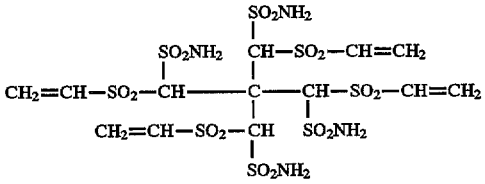
-continued
I-37
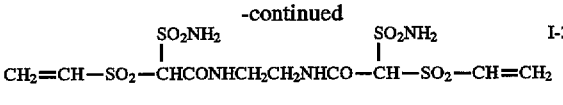
II-1
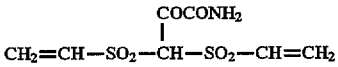
II-2
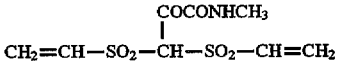
II-3
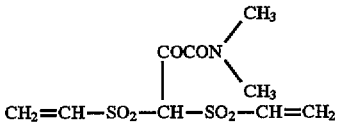
II-4
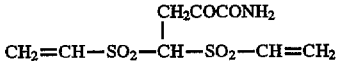
II-5
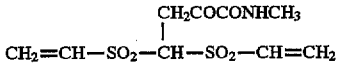
II-6
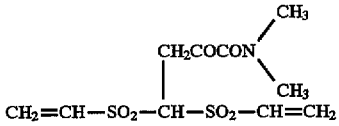
II-7
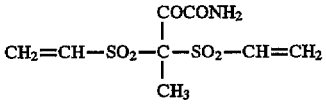
II-8
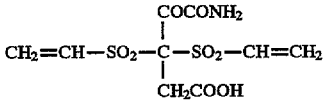
II-9
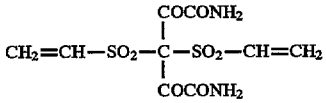
II-10
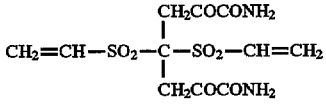
II-11
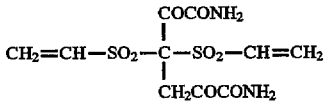
II-12
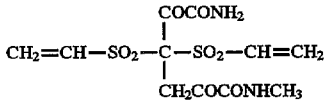
II-13
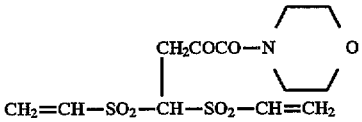
II-14
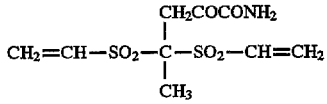

-continued
II-15
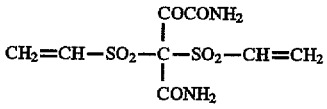
II-16
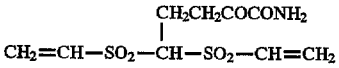
II-17
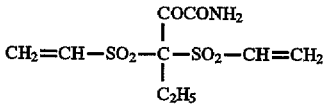
II-18
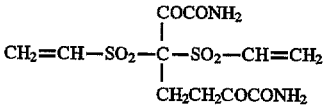
II-19
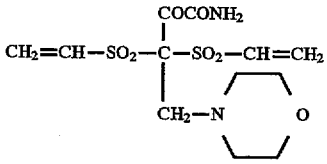
II-20
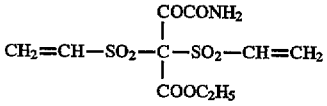
II-21
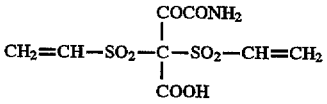
II-22
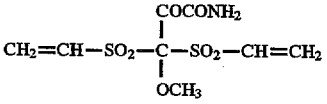
II-23
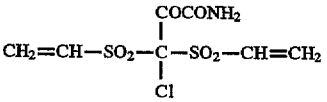
II-24
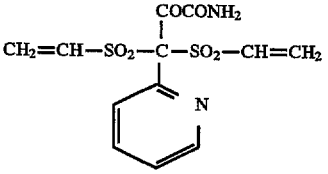
II-25
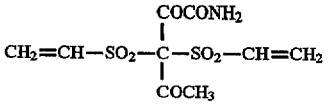
II-26
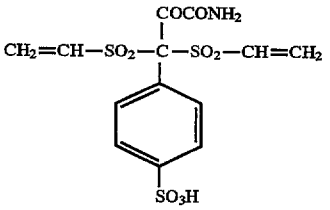
-continued
II-27
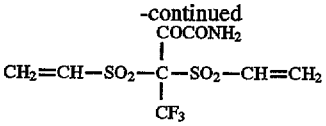
II-28
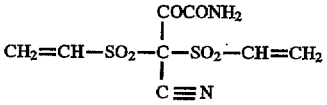
II-29
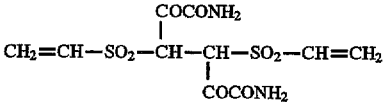
II-30
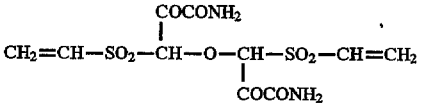
II-31
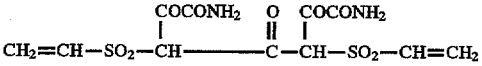
II-32
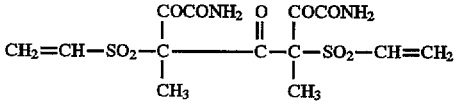
II-33
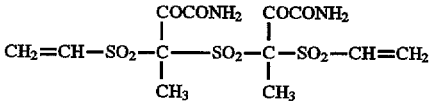
II-34
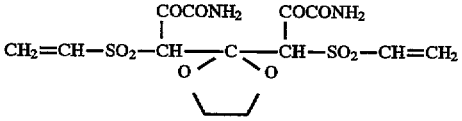
II-35
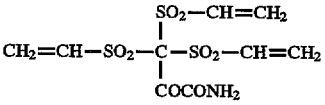
II-36
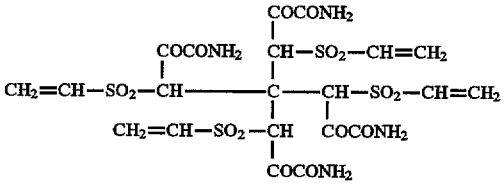
II-37
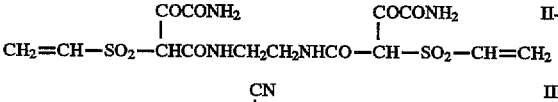
III-1
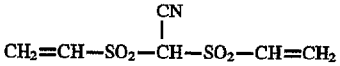
III-2
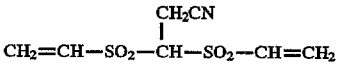
III-3
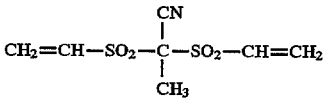
III-4
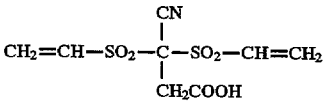

-continued
III-5
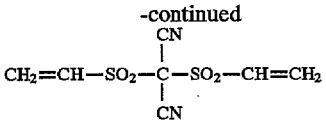
III-6
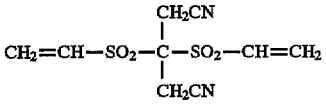
III-7
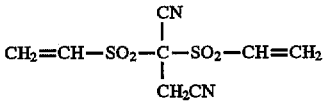
III-8
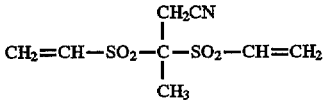
III-9
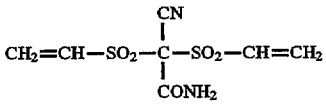
III-10
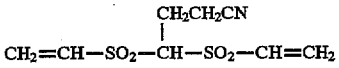
III-11
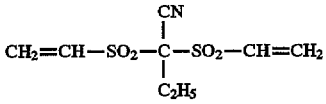
III-12
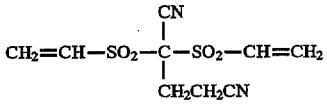
III-13
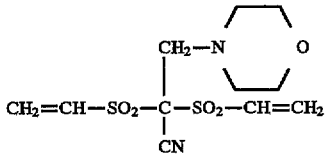
III-14
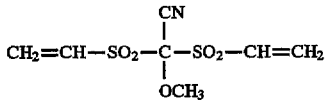
III-15
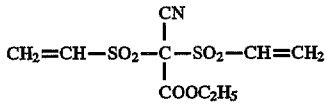
III-16
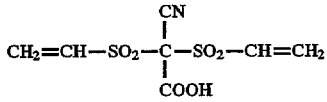
III-17
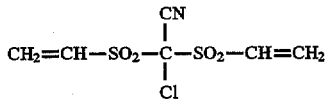
III-18
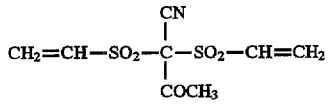
-continued
III-19
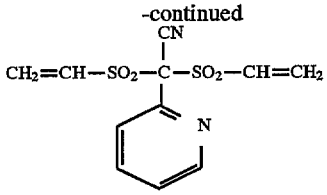
III-20
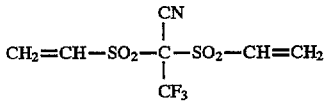
III-21
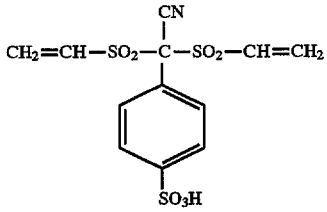
III-22
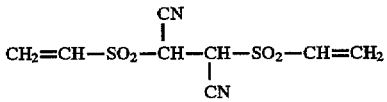
III-23
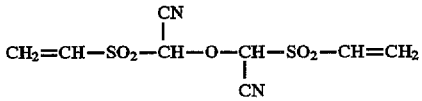
III-24
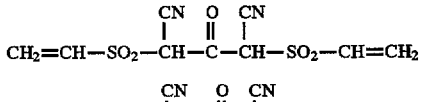
III-25
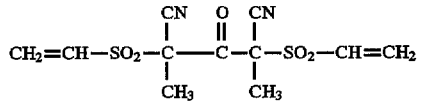
III-26
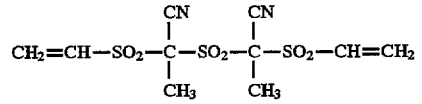
III-27
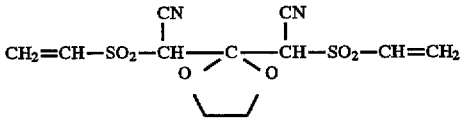
III-28
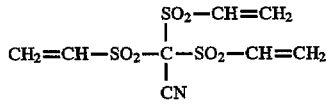
III-29
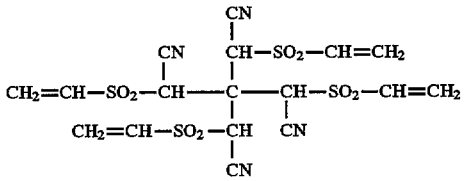
III-30
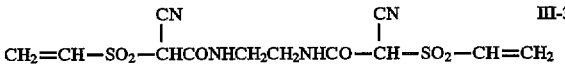
The synthetic method of the compound of the invention will be shown below.
Of compounds represented by formula (I), Compound I-1 can be synthesized according to the following routes:

Route A

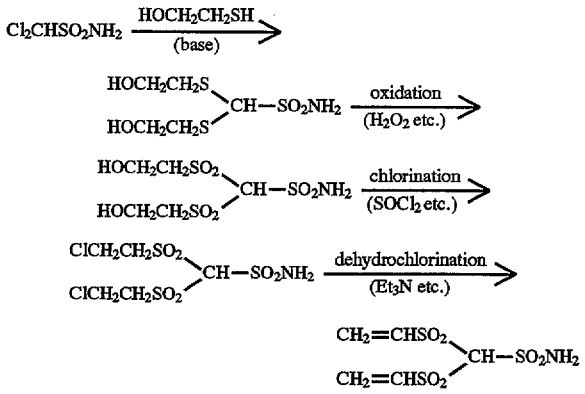

The compound can be also synthesized according to following route.

Route B

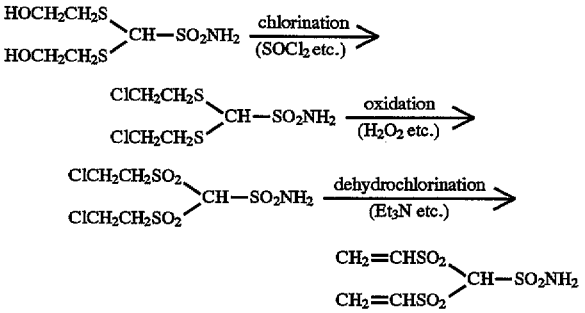

The compound can be also synthesized according to following route.

Route C

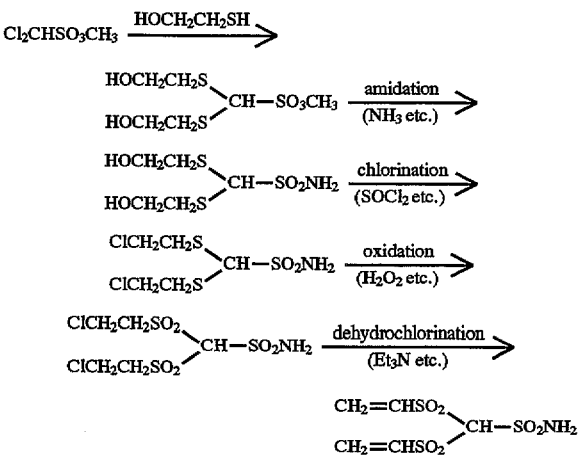

The compound can be also synthesized according to following route.

Route D

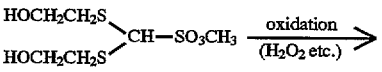

-continued

Route D

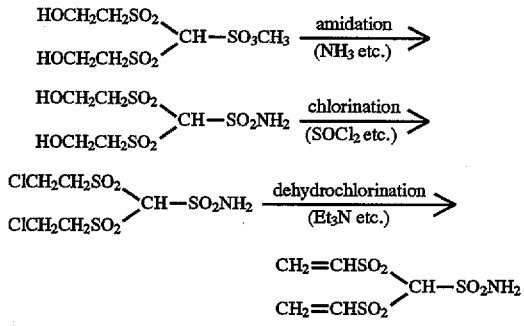

Compound I-3 can be synthesized using $Cl_2CHSO_2N(CH_3)_2$ or $Cl_2CHSO_3CH_3$ in the same manner as the routes (routes A, B, C and D) in I-1 above, but can be also synthesized according to following route.

Route E

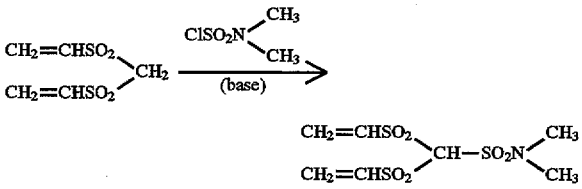

Compound I-4 can be synthesized in the same manner as the routes (routes A, B, C and D) in I-1 above, but can be also synthesized according to following route.

Route F

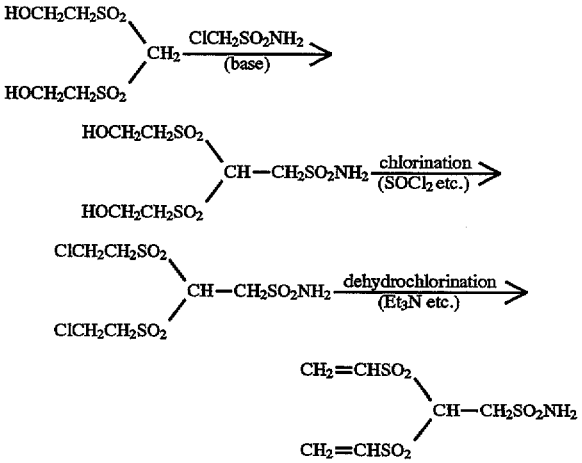

Compound I-4 can also be synthesized according to the following route.

Route G

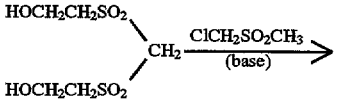

-continued

Route G

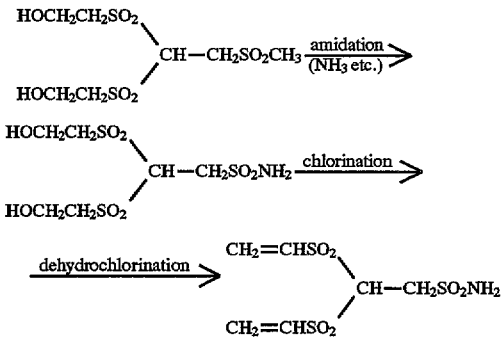

The compound can be also synthesized according to following route.

Route H

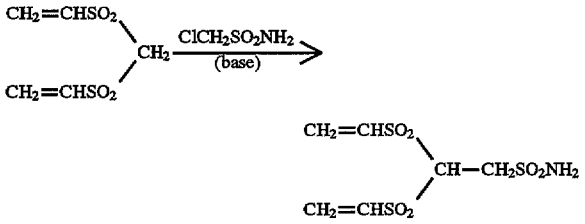

The other compound represented by Formula (I) can be also synthesized in the same manner as above.

For example, Compound I-7 can be synthesized using $CH_3C(Cl)_2SO_2NH_2$ in the same manner as route A or B or using $CH_3C(Cl)_2SO_3CH_3$ in the same manner as route C or D. The compound can be also synthesized by alkylation of Compound I-1 as a starting compound with $CH_3I$.

Compound I-10 can be synthesized in the same manner as route H, using $ClCH_2SO_2NH_2$ and Compound I-4 as a starting compound or in the same manner as route F, G or H using two times mole of $ClCH_2SO_2NH_2$ or $ClCH_2SO_3CH_3$.

Of compounds of Formula (II), Compound II-1 can be synthesized in the same manner as the above routes (routes A, B, C and D) in above I-1 using $Cl_2CHCOCONH_2$ or $Cl_2CHCOCOOCH_3$.

Compound II-3 can be synthesized in the same manner as the routes (routes A, B, C and D) in above II-1 using $Cl_2CHCOCON(CH_3)_2$ or $Cl_2CHCOCOOCH_3$, but can be also synthesized according to the following route.

Route I

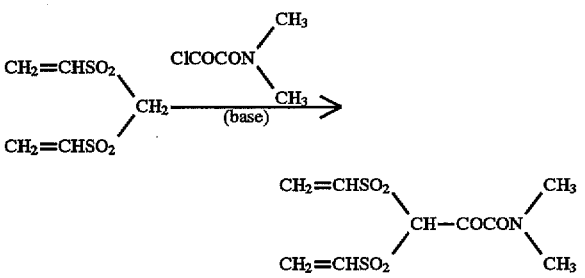

Compound II-4 can be synthesized in the same manner as the routes (routes A, B, C and D) in above II-1, but can be also synthesized in the same manner as the routes (routes F, G and H) in Compound I-4 using $ClCH_2COCONH_2$ or $ClCH_2COCOOCH_3$.

II-4 can be also synthesized according to the following route.

Route J

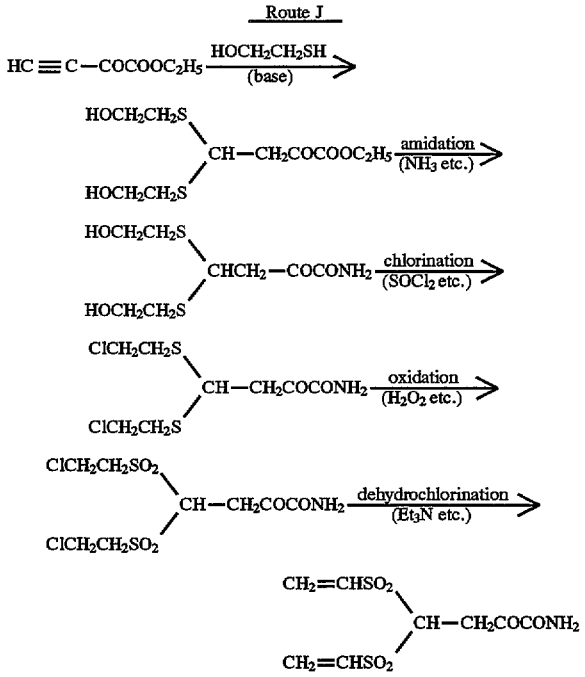

II-4 can be also synthesized according to the following route.

Route K

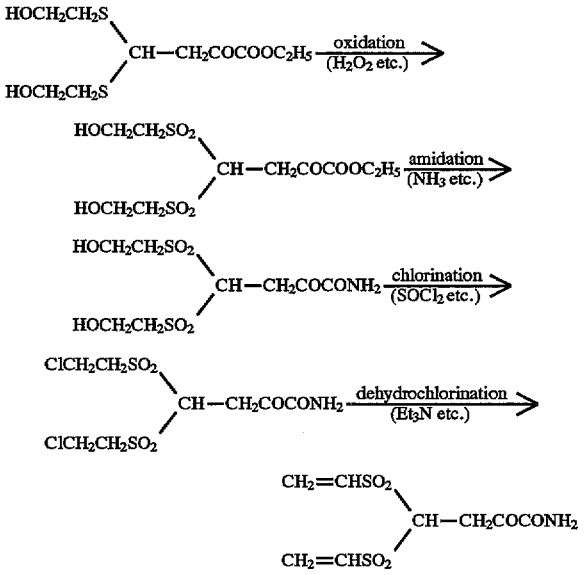

The other compound represented by Formula (II) can be also synthesized in the same manner as above.

For example, Compound II-7 can be synthesized in the same manner as route A or B, using $CH_3C(Cl)_2COCONH_2$ as a starting material or in the same manner as route C or D using $CH_3C(Cl)_2COCOOCH_3$ as a starting material. The compound can be also synthesized by alkylation of Compound II-1 as a starting compound with $CH_3I$.

Compound II-10 can be synthesized in the same manner as route H, using $ClCH_2COCONH_2$ and Compound II-4 as a starting compound or in the same manner as route F, G or H using two times mole of $ClCH_2COCONH_2$ or $ClCH_2COOCH_3$.

Of compounds of Formula (III), Compound III-1 can be synthesized in the same manner as the above routes (routes A and B) in above I-1 using $Cl_2CHCN$, but can be also synthesized according to the following route.

Route L

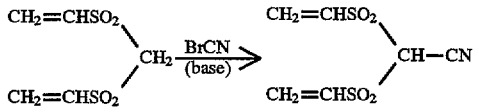

Compound III-2 can be synthesized in the similar manner as the routes (routes A and B) in above III-1, but can be also synthesized in the same manner as the routes (routes F and G) in Compound I-4 using $Cl_2CHCN$ as a starting material.

Compound III-4 can be also synthesized according to the following route.

Route M

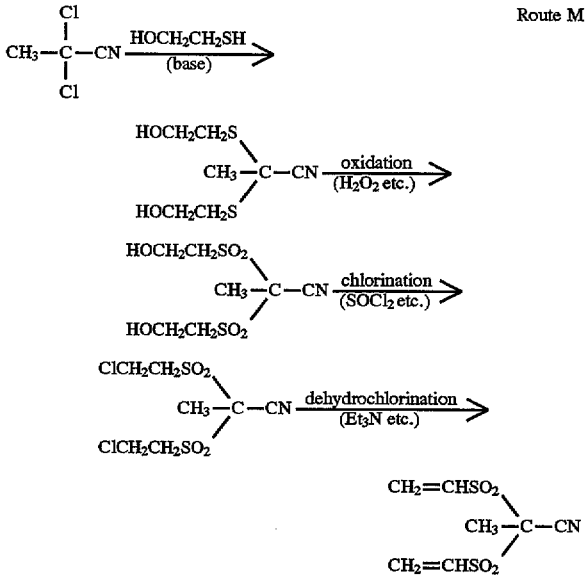

Compound III-4 can be also synthesized according to the following route.

Route N

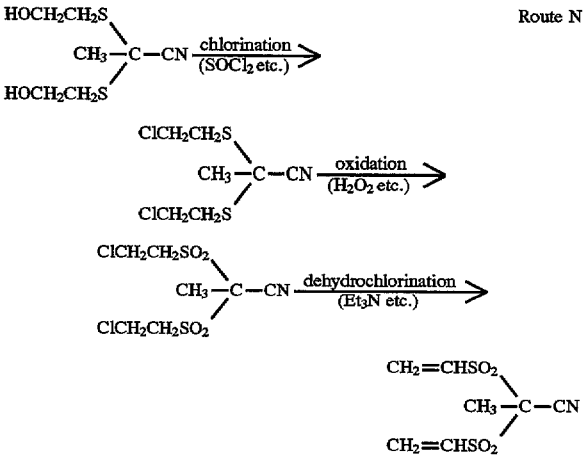

The compound can be also synthesized by alkylation of Compound III-1 as a starting compound with $CH_3I$.

The other compound represented by Formula (III) can be also synthesized in the same manner as above.

For example, Compound III-6 can be synthesized in the same manner as route H using $Cl_2CHCN$ and III-2 as a starting material or in the same manner as route F or H using two times mole of $Cl_2CHCN$.

Compounds of Formula (III) having a cyano group can be obtained by dehydrating the corresponding carbamoyl compounds with phosphorus oxychloride. The corresponding carbamoyl compounds can be synthesized in the same manner as routes A through N in the invention, using $Cl_2CHCONH_2$, $Cl_2CHCOOCH_3$, $Cl_2CHCON(CH_3)_2$, $ClCON(CH_3)_2$, $ClCH_2CONH_2$, $ClCH_2$, $COOCH_3$ or $HC{\equiv}C{-}COOCH_3$ as a starting material. The corresponding carbamoyl compounds can be synthesized according to a method disclosed in U.S. Pat. No. 5,411,856.

These compounds are dissolved in water or a hydrophilic solvent such as methanol and ethanol, and then, added to a photographic coating solution.

A gelatin layer forming a hydrophilic colloid layer is a photographic structural layer containing gelatin such as a light-sensitive or non-sensitive silver halide emulsion layer, a protective layer, an intermediate layer, a filter layer, an anti-static layer, a development adjusting layer, a subbing layer, an anti-halation layer and a backing layer. The addition amount of the compound in the invention represented by Formula (I), (II) or (III) in the above-mentioned layer is not the same depending upon the kind of a compound or a coating solution. It is desirably 0.01 to 2.0 mmol and more desirably 0.03 to 1.0 mmol per 1 g of the total gelatin weight on one side of a support. Gelatin molecules are cross-linked by the compound in the invention, whereby gelatin is hardened.

The compound represented by the above-mentioned Formula (I), (II) or (III) in the present invention may be combined with other conventional hardeners to be used. Practical examples of conventional hardener combined to be used include aldehyde type compounds such as formaline, glyoxal and succinic aldehyde, acid-releasing triazine compounds described in Japanese Patent Publication No. 6151/1972 including sodium 2,4-dichloro-6-hydroxytriazine or carbamoyl pyridium compounds.

The silver halide grains used in the present invention are preferably ordinary crystal grains (including a cubic, octahedral and tetradecahedral) and more preferably tabular grains. The average grain size of silver halide grains is preferably 0.2 to 2.5 μm, and more preferably 0.4 to 2.0 μm.

The average value (referred to as the average aspect ratio) of grain diameter/thickness (referred to as the aspect ratio) in the tabular silver halide grains of the present invention is 3 or more, preferably 3 to 30, more preferably 3 to 20 and most preferably 3 to 10.

The average thickness of the tabular silver halide grains of the present invention is preferably 0.4 μm or less, more preferably 0.3 μm or less and most preferably 0.05 to 0.25 μm.

In the present invention, the diameter of silver halide grains is defined to be diameter of a circle having an area equivalent to the projected area of grains through observation of an electron microscopic photographic of a silver halide grain.

In the present invention, the thickness of silver halide grains is defined to be the minimum distance between two parallel planes constituting tabular silver halide grains. The thickness of tabular silver halide grains can be calculated by means of an electron microscopic photography provided with shadow of silver halide grains or an electron microscopic photography of the dislocation of a sample wherein a silver halide emulsion is coated on a support to be dried.

In order to calculate the average aspect ratio, at least 100 samples are measured.

In the silver halide emulsion in the present invention, a ratio of tabular silver halide grains to the total silver halide grains is preferably 50% or more, more preferably 60% or more and most preferably 70% or more.

The tabular silver halide emulsion in the present invention is preferably mono-dispersed. Silver halide grains whose grain size is included in ±20% of the average grain size are preferably 50 wt % or more. In addition, it is also desirable to mix mono-dispersed grains to use. In such an instance, the grain size distribution of grains in the light-sensitive material has two or more maximum values.

In the tabular silver halide emulsion of the present invention, any of halogen composition such as silver chloride, silver bromide, silver iodochloride, silver bromochloride, silver bromoiodide and silver bromochloroiodide may be used. In terms of high sensitivity, silver bromochloroiodide is preferable. The average silver iodide content is 0 to 4.0 mol % and preferably 0.2 to 3.0 mol %. The average silver chloride content is 0 to 5 mol %. In the tabular silver halide emulsion in the present invention, the halogen composition may be uniform or silver iodide may be localized in a grain, and one wherein silver iodide is localized in the central portion is preferably used.

For a production method of the tabular silver halide emulsion, it is possible to refer to Japanese Patent OPI Publication Nos. 113926/1983, 113927/1983, 113934/1983 and 1855/1987 and European Patent Nos. 219,849 and 219,850.

For a production method of a mono-dispersed tabular silver halide emulsion, it is possible to refer to Japanese Patent OPI Publication No. 6643/1986.

A tabular silver bromoiodide emulsion having high aspect ratio can be produced in a method wherein an aqueous gelatin solution whose pBr is kept at 2 or lower, an aqueous silver nitrate solution is added or an aqueous silver and an aqueous halogenized solution are added concurrently to create seed crystals, and then, grow them by means of a double jet method.

Size of a tabular silver halide grain can be controlled by temperature during formation of grains and by addition speed of silver salt and an aqueous halogenated solution.

The average silver iodide content of the tabular silver halide emulsion can be controlled by changing the composition of an aqueous halogenated substance added, i.e., the ratio between a bromide and a iodide.

In producing tabular silver halide grains, a silver halide solvent such as ammonia, thioether and thiourea can be used.

In order to remove a soluble salt from an emulsion, a water-washing methods such as a noodle water-washing method and a flocculation precipitation method are allowed to be used. As a desirable water-washing method, a method that uses an aromatic hydrocarbon aldehyde resin containing a sulfo group described in Japanese Patent OPI Publication No. 16086/1960 is cited. In addition, as a desirable desalting method, a method that uses illustrated coagulation polymers G-3 and G-8 described in Japanese Patent OPI Publication No. 7037/1990 is cited.

An emulsion used for the photographic coating solution of the present invention can be produced by a conventional method. For example, methods described in 1. Emulsion Preparation and types in Research Disclosure (RD) No. 17643 (December, 1978), pp. 22 to 23 and RD. No. 18716 (November, 1979), on page 648 can be used.

The emulsion used for the photographic coating solution of the present invention can be prepared by methods described in "The Theory of the Photographic Process" 4th Edition (1977), written by T. H. James, published by Macmillan Inc., on pp. 38 to 104, "Photographic Emulsion Chemistry" (1966) written by G. F. Dauffin, published by Focal Press Inc., "Chimie et Physique Photographique" written by P. Glafkides, published by Paul Montel (1967) and "Making and Coating Photographic Emulsion" written by V. L. Zelikman and others, published by Focal Press Inc. (1964).

Namely, under a solution condition of a neutral method, an acid method and an ammonia method, a mixing condition of an ordinary mixing method, a reverse mixing method, a double jet method and a controlled double jet method and a grain preparation condition of a conversion method and a core/shell method and their mixture can be selected for producing the emulsion. One of desirable embodiments of the present invention is a mono-dispersed emulsion wherein silver iodides are localized inside each grain.

The silver halides, chemical sensitizers, silver halide solvents, spectral sensitizing dyes, anti-foggants, hydrophilic protective colloids such as gelatin, UV absorbers, polymer latexes, brightening agents, color couplers, anti-fading agents, dyes, matting agents or surfactants, which are used in a silver halide emulsion layer or other layers of the light sensitive materials used in the invention, are used without any limitation.

To the emulsion used in the silver halide photographic light sensitive material of the present invention, various photographic additives can be added during a physical ripening step or before or after a chemical ripening step. As conventional additives, for example, compounds described in Research Disclosure Nos. 17643, 18716 (November, 1979) and 308119 (December, 1989) are cited. Kind of compound and place described in these three RDs are illustrated as follows:

| | RD-17643 | | RD-18716 | | RD-308119 | |
|---|---|---|---|---|---|---|
| Additive | Page | Classification | Page | Classification | Page | Classification |
| Chemical sensitizer | 23 | III | 648 upper right | | 996 | III |
| Sensitizing dye | 23 | IV | 648–649 | | 996–8 | IVA |
| Desensitizing dye | 23 | IV | | | 998 | IVB |
| Pigment | 25–26 | VIII | 649–650 | | 1003 | VIII |
| Development accelerator | 29 | XXI | 648 upper right | | | |
| Anti-foggant and stabilizer | 24 | IV | 649 upper right | | 1006–7 | VI |
| Brightening agent | 24 | V | | | 998 | V |
| Surfactant | 26–7 | XI | 650 right | | 1005–6 | XI |
| Anti-static agent | 27 | XII | 650 right | | 1006–7 | XIII |
| Plasticizer | 27 | XII | 650 right | | 1006 | XII |
| Lubricant | 27 | XII | | | | |
| Matting agent | 28 | XVI | 650 right | | 1008–9 | XVI |
| Binder | 26 | XXII | | | 1003–4 | IX |
| Support | 28 | XVII | | | 1009 | XVII |

As a support capable of being used in the light-sensitive material of the present invention, those described in the above-mentioned RD-17643, page 28 and RD-308119, page 1009 are cited As a suitable support, a plastic film is cited. On the surface of such a support, a subbing layer, corona discharge for UV irradiation may be provided for the better adhesion of coating layer.

The photographic coating solution wherein the present invention can be applied are used for a direct x-ray film, an indirect X-ray film, an X-ray reversal film for duplicating use, a film for a CT imager, a film for a laser imager, a graveur film for graphic arts, a line image film for graphic arts, a dot-photographing film for graphic arts, a contact-printing film for graphic arts, a black-and-white film for photography and a color film for photography.

A light-sensitive material formed by the use of the photographic coating solution of the present invention can be subjected to photographic processing by means of a conventional method. For example, various methods and various processing solutions described in Research Disclosure No. 17643 can be used.

EXAMPLES

The invention will be detailed according to the following examples, but it is not limited thereto.

Example 1

The following layer compositions were sequentially formed on a triacetyl cellulose film support having a subbing layer in the order from the support side to yield multi-layered color photographic light-sensitive material samples, I-A through I-E, II-A through II-E, III-A through III-E and IV-A.

The addition amount of compounds in silver halide photographic light-sensitive material is expressed in gram per $m^2$, unless otherwise stated. The amount for silver halide and colloidal silver is converted to the amounts of silver, and the amount of sensitizing dyes are shown in mol per mol of silver.

| | |
|---|---|
| Layer 1: Antihalation layer | |
| Black colloidal silver | 0.16 |
| UV absorbent (UV-1) | 0.20 |
| High boiling solvent (Oil-1) | 0.12 |
| Gelatin | 1.53 |
| Layer 2: Intermediate layer | |
| Antistaining agent (SC-1) | 0.06 |
| High boiling solvent (Oil-2) | 0.08 |
| Gelatin | 0.80 |
| Layer 3: Low speed red-sensitive emulsion layer | |
| Silver iodobromide emulsion (Average grain size 0.38 μm, Silver iodide content 8.0 mol %) | 0.43 |
| Silver iodobromide emulsion (Average grain size 0.27 μm, Silver iodide content 2.0 mol %) | 0.15 |
| Sensitizing dye (SD-1) | $2.8 \times 10^{-4}$ |
| Sensitizing dye (SD-2) | $1.9 \times 10^{-4}$ |
| Sensitizing dye (SD-3) | $1.9 \times 10^{-4}$ |
| Sensitizing dye (SD-4) | $1.0 \times 10^{-4}$ |
| Cyan coupler (C-1) | 0.56 |
| Colored cyan coupler (CC-1) | 0.021 |
| DIR compound (D-1) | 0.025 |
| High boiling solvent (Oil-1) | 0.49 |
| Gelatin | 1.14 |
| Layer 4: Medium speed red-sensitive emulsion layer | |
| Silver iodobromide emulsion (Average grain size 0.52 μm, Silver iodide content 8.0 mol %) | 0.89 |
| Silver iodobromide emulsion (Average grain size 0.38 μm, Silver iodide content 8.0 mol %) | 0.22 |
| Sensitizing dye (SD-1) | $2.3 \times 10^{-4}$ |

-continued

| | |
|---|---|
| Sensitizing dye (SD-2) | $1.2 \times 10^{-4}$ |
| Sensitizing dye (SD-3) | $1.6 \times 10^{-4}$ |
| Cyan coupler (C-1) | 0.45 |
| Colored cyan coupler (CC-1) | 0.038 |
| DIR compound (D-1) | 0.017 |
| High boiling solvent (Oil-1) | 0.39 |
| Gelatin | 1.01 |
| Layer 5: High speed red-sensitive emulsion layer | |
| Silver iodobromide emulsion (Average grain size 1.00 μm, Silver iodide content 8.0 mol %) | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-4}$ |
| Cyan coupler (C-2) | 0.20 |
| Colored cyan coupler (CC-1) | 0.034 |
| DIR compound (D-3) | 0.001 |
| High boiling solvent (Oil-1) | 0.57 |
| Gelatin | 1.10 |
| Layer 6: Intermediate layer | |
| Antistaining agent (SC-1) | 0.075 |
| High boiling solvent (Oil-2) | 0.095 |
| Gelatin | 1.00 |
| Layer 7: Intermediate layer | |
| Gelatin | 0.45 |
| Layer 8: Low speed green-sensitive emulsion layer | |
| Silver iodobromide emulsion (Average grain size 0.38 μm, Silver iodide content 8.0 mol %) | 0.64 |
| Silver iodobromide emulsion (Average grain size 0.27 μm, Silver iodide content 2.0 mol %) | 0.21 |
| Sensitizing dye (SD-4) | $7.4 \times 10^{-4}$ |
| Sensitizing dye (SD-5) | $6.6 \times 10^{-4}$ |
| Magenta coupler (M-1) | 0.19 |
| Magenta coupler (M-2) | 0.49 |
| Colored magenta coupler (CM-1) | 0.12 |
| High boiling solvent (Oil-2) | 0.81 |
| Gelatin | 1.89 |
| Layer 9: Medium speed green-sensitive emulsion layer | |
| Silver iodobromide emulsion (Average grain size 0.59 μm, Silver iodide content 8.0 mol %) | 0.76 |
| Sensitizing dye (SD-6) | $1.5 \times 10^{-4}$ |
| Sensitizing dye (SD-7) | $1.6 \times 10^{-4}$ |
| Sensitizing dye (SD-8) | $1.5 \times 10^{-4}$ |
| Magenta coupler (M-1) | 0.043 |
| Magenta coupler (M-2) | 0.10 |
| Colored magenta coupler (CM-2) | 0.039 |
| DIR compound (D-2) | 0.021 |
| DIR compound (D-3) | 0.002 |
| High boiling solvent (Oil-2) | 0.37 |
| Gelatin | 0.76 |
| Layer 10: High speed green-sensitive emulsion layer | |
| Silver iodobromide emulsion (Average grain size 1.00 μm, Silver iodide content 8.0 mol %) | 1.46 |
| Sensitizing dye (SD-6) | $0.93 \times 10^{-4}$ |
| Sensitizing dye (SD-7) | $0.97 \times 10^{-4}$ |
| Sensitizing dye (SD-8) | $0.93 \times 10^{-4}$ |
| Magenta coupler (M-1) | 0.08 |
| Magenta coupler (M-2) | 0.133 |
| Colored magenta coupler (CM-2) | 0.014 |
| High boiling solvent (Oil-1) | 0.15 |
| High boiling solvent (Oil-2) | 0.42 |
| Gelatin | 1.08 |
| Layer 11: Yellow filter layer | |
| Yellow colloidal silver | 0.07 |
| Antistaining agent (SC-1) | 0.18 |
| Formalin scavenger (HS-1) | 0.14 |
| High boiling solvent (Oil-2) | 0.21 |
| Gelatin | 0.73 |
| Layer 12: Intermediate layer | |
| Formalin scavenger (HS-1) | 0.18 |
| Gelatin | 0.60 |

-continued

| | |
|---|---|
| Layer 13: Low speed blue-sensitive emulsion layer | |
| Silver iodobromide emulsion (Average grain size 0.59 μm, Silver iodide content 8.0 mol %) | 0.073 |
| Silver iodobromide emulsion (Average grain size 0.38 μm, Silver iodide content 3.0 mol %) | 0.16 |
| Silver iodobromide emulsion (Average grain size 0.27 μm, Silver iodide content 2.0 mol %) | 0.20 |
| Sensitizing dye (SD-9) | $2.1 \times 10^{-4}$ |
| Sensitizing dye (SD-10) | $2.8 \times 10^{-4}$ |
| Yellow coupler (Y-1) | 0.89 |
| DIR compound (D-4) | 0.008 |
| High boiling solvent (Oil-2) | 0.37 |
| Gelatin | 1.51 |
| Layer 14: High speed blue-sensitive emulsion layer | |
| Silver iodobromide emulsion (Average grain size 1.00 μm, Silver iodide content 8.0 mol %) | 0.95 |
| Sensitizing dye (SD-9) | $7.3 \times 10^{-4}$ |
| Sensitizing dye (SD-10) | $2.8 \times 10^{-4}$ |
| Yellow coupler (Y-1) | 0.16 |
| High boiling solvent (Oil-2) | 0.093 |
| Gelatin | 0.80 |
| Layer 15: First protective layer | |
| Silver iodobromide emulsion (Average grain size 0.05 μm, Silver iodide content 3.0 mol %) | 0.30 |
| UV absorbent (UV-1) | 0.094 |
| UV absorbent (UV-2) | 0.10 |
| Formalin scavenger (HS-1) | 0.38 |
| High boiling solvent (Oil-1) | 0.10 |

-continued

| | |
|---|---|
| Gelatin | 1.44 |
| Layer 16: Second protective layer | |
| Alkali-soluble matting agent (Average grain size of 2 μm) | 0.15 |
| Polymethyl methacrylate (Average grain size of 3 μm) | 0.04 |
| Lubricant (WAX-1) | 0.02 |
| Gelatin | 0.55 |

In addition to the above compounds, a coating aid SU-1, a dispersing agent SU-2, a viscosity controlling agent, a stabilizer ST-1, dyes AI-1 and AI-2, an antifogging agent AF-1, a stabilizing agent ST-1, polyvinylpyrrolidone having a weight average molecular weight of 10,000, polyvinylpyrrolidone having a weight average molecular weight of 100,000 and antseptic agent DI-1 were added. The addition amount of DI-1 was 9.4 mg/m$^2$.

Inventive hardeners and comparative hardener were added to the second protective layer immediately before coating. The addition amount of the hardeners is an amount based on the total gelatin amount (the sum of gelatin added to the first layer through the sixteenth second layer) which is shown in Table 2.

The chemical structures of the compounds used in the above layers are shown below.

C-1

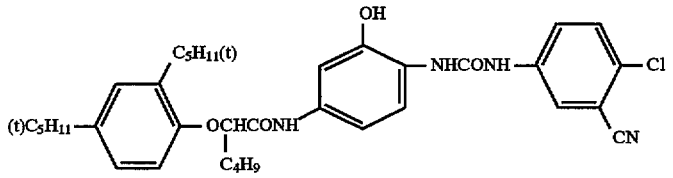

C-2

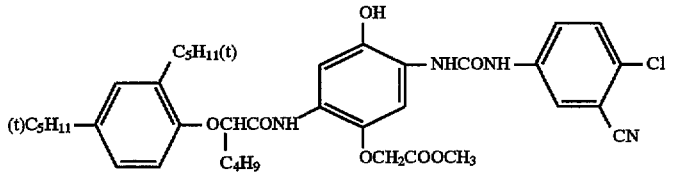

M-1

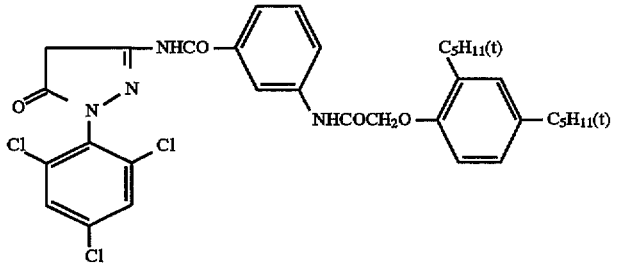

M-2

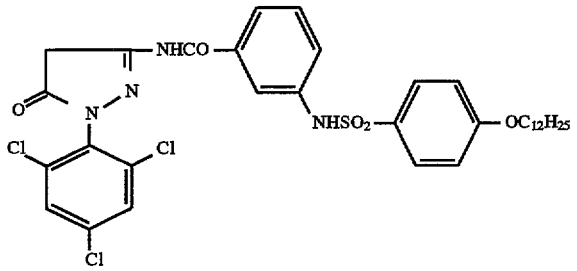

-continued
Y-1
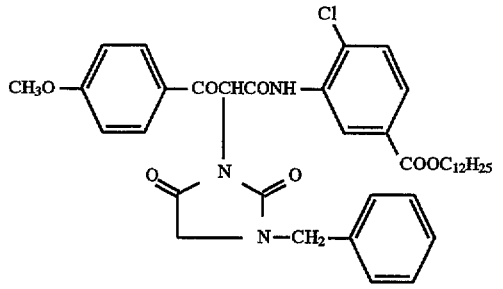
CC-1
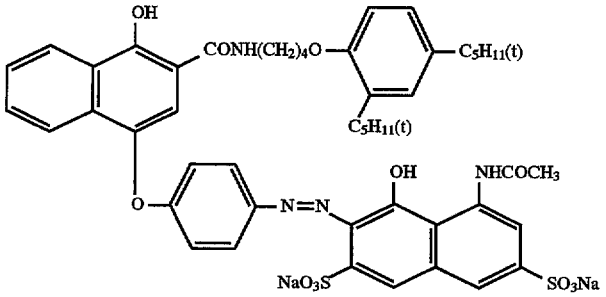
CM-1
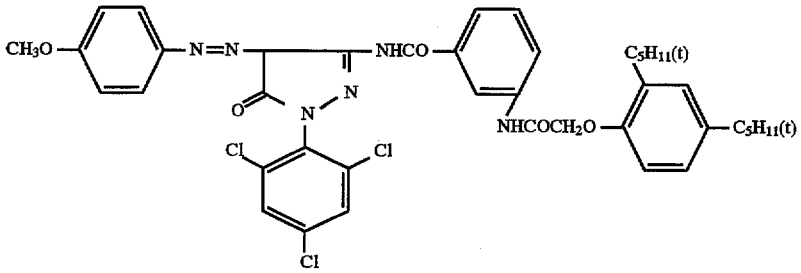
CM-2
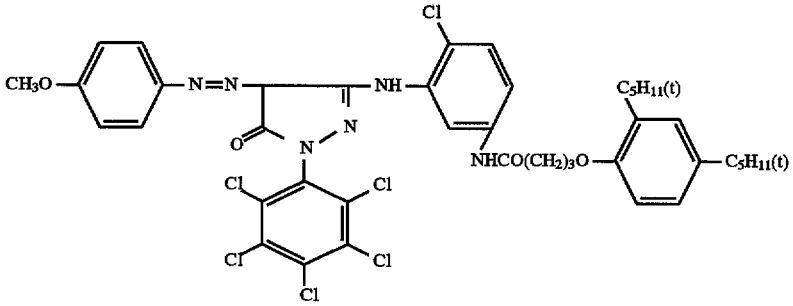
D-1
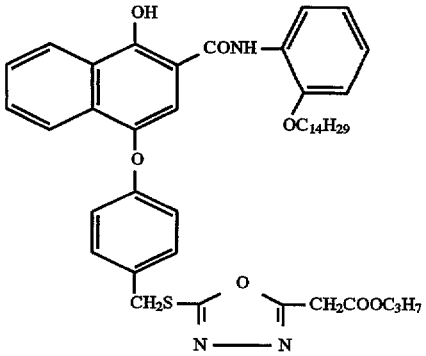

-continued
D-2
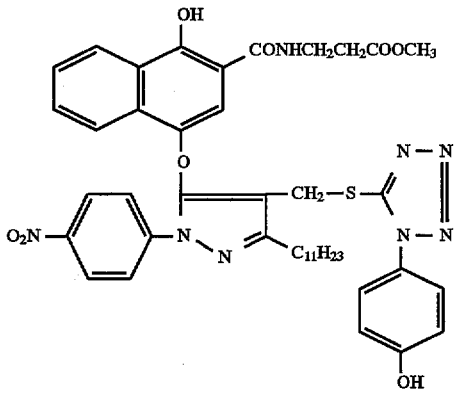
D-3
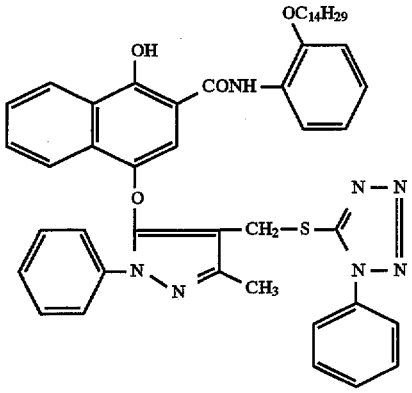
D-4
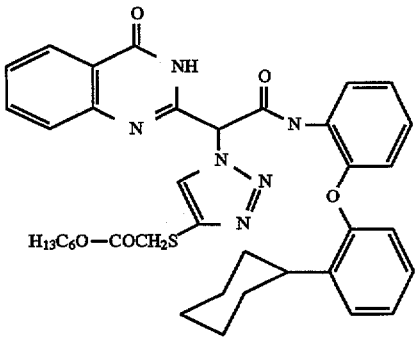
Oil-1
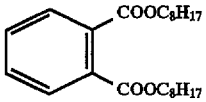
Oil-2
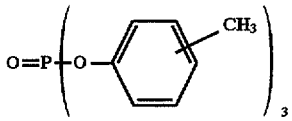
SC-1
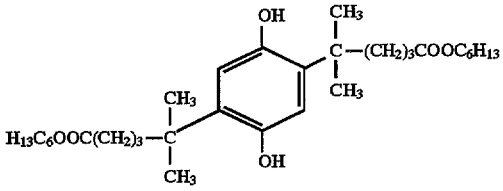

-continued
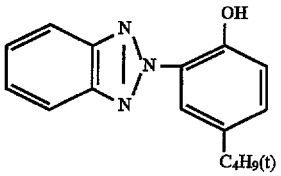
UV-1
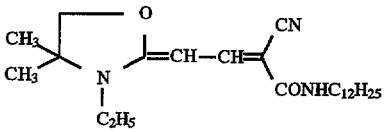
UV-2
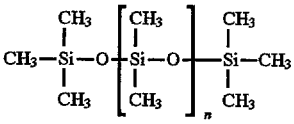
WAX-1
weight average molecular weight MW: 3,000
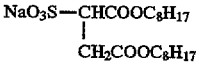
SU-1
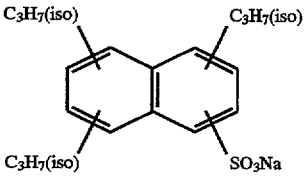
SU-2
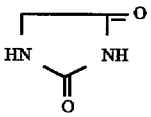
HS-1
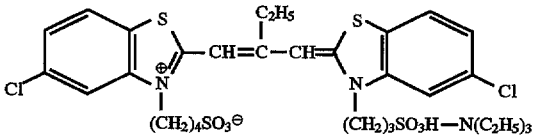
SD-1
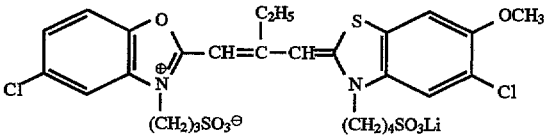
SD-2
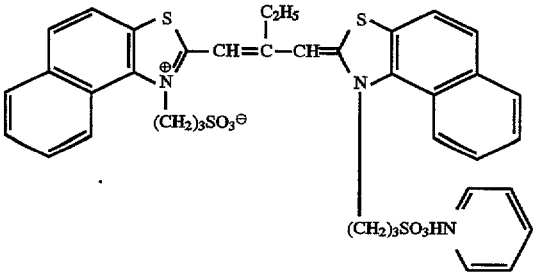
SD-3
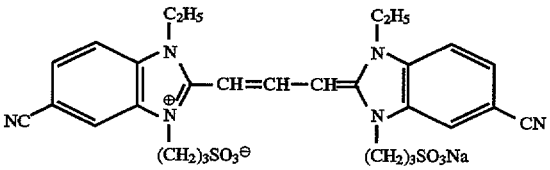
SD-4

-continued
SD-5
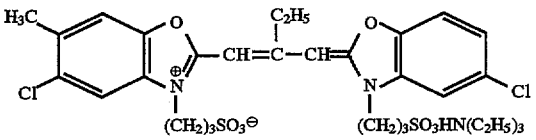
SD-6
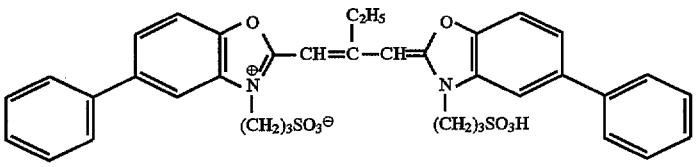
SD-7
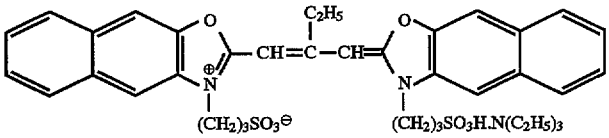
SD-8
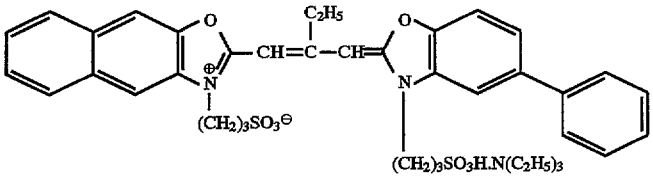
SD-9
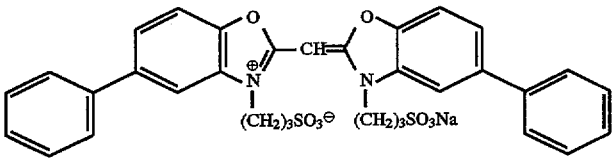
SD-10
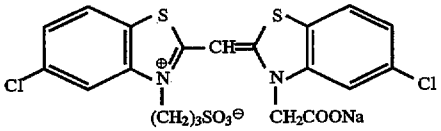
ST-1
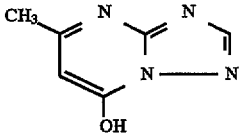
AF-1
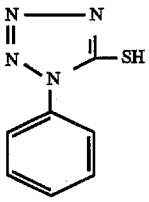
DI-1 (a mixture of the following three components)
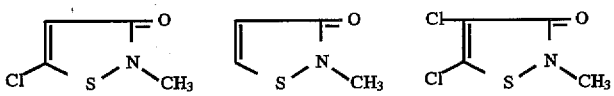
(Component A) (Component B) (Component C)
Component A:Component B:Component C = 50:46:4 (mole ratio)

-continued

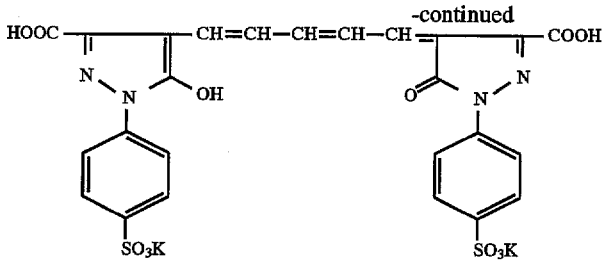

AI-1

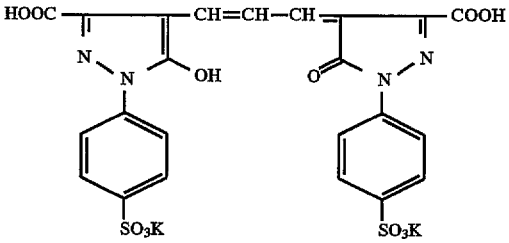

AI-2

The above obtained samples were fresh samples, and the samples were further stored at 50° C. and 50% RH for three days. These samples were wedge exposed to a white light and processed according to the following processing steps, and sensitivity and fog were measured.

Sensitivity was represented by a reciprocal of exposure necessary to give a density of fog plus 0.5, and sensitivity of samples was represented in terms of sensitivity relative to sensitivity of Sample No. I-A stored at 50° C. and 50% RH for three days after coating being defined as 100.

Separate portions of the fresh samples were stored at 50° C. and 50% RH for 3 hours, 2 days and 3 days, and each portion was then immersed in 30° C. water for 5 minutes. A sapphire needle having a radius of 0.3 mm was brought into pressure contact with the surface of the resulting three samples and moved at a rate of 2 mm/second while applying load continuously varying from 0 to 200 g. Thus, the load at which the surface of the samples was first damaged was designated as surface strength.

The above results are collectively shown in Table 2.

(Processing Steps)

| Processing Step | Processing Time | Processing Temperature | Replenishing Amount* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 60 sec. | 55 ± 5.0° C. | — |

*Replenishing amount is an amount per $m^2$ of light sensitive material processed.

The processing solutions and replenishing solutions are prepared according to the following.

<Preparation of processing solutions>
(Color Developing solution)

| | |
|---|---|
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |

-continued

<Preparation of processing solutions>
(Color Developing solution)

| | |
|---|---|
| Hydroxylamine sulfate | 2.5 g |
| Sodium chloride | 0.6 g |
| 4-amino-3-methyl-N-ethyl-N-(b-hydroxyethyl)aniline sulfate | 4.5 g |
| Diethylene triamine pentaacetic acid | 3.0 g |
| Potassium hydroxide | 1.2 g |

Water was added to make 1.0 liter, and the developing solution was regulated to pH 10.06 by the use of potassium hydroxide or a 20% surfuric acid solution.

(Color developing replenishing solution)

| | |
|---|---|
| Water | 800 ml |
| Potassium carbonate | 35 g |
| Sodium hydrogencarbonate | 3.0 g |
| Potassium sulfite | 5.0 g |
| Sodium bromide | 0.4 g |
| Hydroxylamine sulfate | 3.1 g |
| 4-amino-3-methyl-N-ethyl-N-(b-hydroxyethyl)aniline sulfate | 6.3 g |
| Diethylene triamine pentaacetic acid | 3.0 g |
| Potassium hydroxide | 2.0 g |

Water was added to make 1.0 liter, and the replenishing developing solution was regulated to pH 10.18 by the use of potassium hydroxide or a 20% surfuric acid solution.

(Bleaching solution)

| | |
|---|---|
| Water | 700 ml |
| Ferric (III) ammonium of 1,3-diaminopropane tetraacetic acid | 125 g |
| Ethylenediamine tetraacetic acid | 2 g |
| Sodium nitrate | 40 g |
| Ammonium bromide | 150 g |
| Glacial acetic acid | 40 g |

Water was added to make 1.0 liter, and the bleaching solution was regulated to pH 4.4 by the use of aqueous ammonia or glacial acetic acid.

| (Bleaching replenishing solution) | |
|---|---|
| Water | 700 ml |
| Ferric (III) ammonium of 1,3-diaminopropane tetraacetic acid | 175 g |
| Ethylenediamine tetaacetic acid | 2 g |
| Sodium nitrate | 50 g |
| Ammonium bromide | 200 g |
| Glacial acetic acid | 56 g |

Water was added to make 1 liter, and the replenishing bleaching solution was regulated to pH 4.0 by the use of aqueous ammonia or glacial acetic acid.

| Fixing solution) | |
|---|---|
| Water | 800 ml |
| Ammonium thiocyanate | 120 g |
| Ammonium thiosulfate | 150 g |
| Sodium sulfite | 15 g |
| Ethylenediamine tetraacetic acid | 2 g |

Water was added to make 1 liter, and the fixing solution was regulated to pH 6.2 by the use of aqueous ammonia or glacial acetic acid.

| (Fixing replenishing solution) | |
|---|---|
| Water | 800 ml |
| Ammonium thiocyanate | 150 g |
| Ammonium thiosulfate | 180 g |
| Sodium sulfite | 20 g |
| Ethylenediamine tetraacetic acid | 2 g |

Water was added to make 1 liter, and the replenishing solution to pH 6.5 by the use of aqueous ammonia or glacial acetic acid.

| Stabilizing solution and stabilizing replenishing solution) | |
|---|---|
| Water | 900 ml |
| p-Octylphenol ethyleneoxide (10 mol) adduct | 2.0 g |
| Dimethylol urea | 0.5 g |
| Hexamethylene tetraamine | 0.2 g |
| 1,2-benzisothiazoline-3-on | 0.1 g |
| Siloxane (L-77 produced by UCC) | 0.1 g |
| Aqueous ammonia | 0.5 ml |

Water was added to make 1.0 liter, and pH was regulated to 8.5 by the use of aqueous ammonia or a 50% sulfuric acid solution.

TABLE 2

| Sample | Hardener | | Photographic properties | | | | |
|---|---|---|---|---|---|---|---|
| | | Addition amount mmol/100 g of | Forced aging conditions 3 days (50° C., 50% RH) | | Hardening property Surface strength (g) | | |
| No. | Kinds | gelatin | Sensitivity | Fog | 3 hrs | 2 days | 3 days |
| I-A (INV.) | I-4 | 10 | 100 | 0.07 | 120 | 130 | 130 |
| I-B (INV.) | I-5 | 10 | 99 | 0.07 | 125 | 133 | 133 |
| I-C (INV.) | I-7 | 10 | 101 | 0.07 | 118 | 128 | 128 |
| I-D (INV.) | I-8 | 10 | 99 | 0.07 | 115 | 132 | 132 |
| I-E (INV.) | I-11 | 10 | 99 | 0.07 | 123 | 130 | 130 |
| II-A (INV.) | II-4 | 10 | 100 | 0.07 | 120 | 129 | 129 |
| II-B (INV.) | II-5 | 10 | 98 | 0.07 | 124 | 133 | 133 |
| II-C (INV.) | II-7 | 10 | 101 | 0.07 | 125 | 131 | 131 |
| II-D (INV.) | II-8 | 10 | 99 | 0.07 | 122 | 132 | 132 |
| II-E (INV.) | II-11 | 10 | 98 | 0.07 | 120 | 130 | 130 |
| III-A (INV.) | III-2 | 10 | 100 | 0.07 | 117 | 127 | 127 |
| III-B (INV.) | III-3 | 10 | 100 | 0.07 | 122 | 133 | 133 |
| III-C (INV.) | III-4 | 10 | 99 | 0.07 | 119 | 129 | 129 |
| III-D (INV.) | III-5 | 10 | 99 | 0.07 | 120 | 130 | 130 |
| III-E (INV.) | III-7 | 10 | 100 | 0.07 | 122 | 131 | 131 |
| IV-A (Comp.) | Comparative compound (1) | 10 | 96 | 0.09 | 100 | 105 | 110 |

Comparative compound (1)

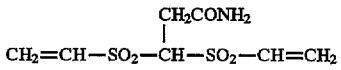

(compound disclosed in U.S. Pat. No. 5,411,856)

As is apparent from Table 2, Samples I-A through I-E, II-A through II-E and III-A through III-E, which employ the hardener of the invention, minimize fog increase and relative sensitivity lowering under the forced aging conditions. Accordingly, the hardener of the invention has no adverse affect on the photographic properties. As is also seen from the test results of the hardening property, the surface strength of Samples I-A through I-E, II-A through II-E and III-A through III-E does not vary after the two day or more storage, but Comparative sample IV-B does. Accordingly, the hardener of the invention has no after-hardening property.

Example 2

(Preparation of Seed emulsion-I)

Seed emulsion-I was prepared by the following method.

| | |
|---|---|
| Solution A1 | |
| Ossein gelatin | 24.2 g |
| Distilled water | 9657 ml |
| Propyleneoxy-polyethyleneoxy-discuccinate sodium salt (10% ethanol solution) | 6.78 ml |
| KBr | 10.8 g |
| 10% nitric acid | 114 ml |
| Solution B1 | |
| 2.5N aqueous $AgNO_3$ solution | 2825 ml |
| Solution C1 | |
| KBr | 841 g |
| Water was added to make 2825 ml. | |
| Solution D1 | |
| 1.75N aqueous KBr solution | an amount for controlling the following silver potential |

By the use of a mixing stirrer described in Japanese Patent Publication Nos. 58288/1983 and 58289/1982, 464.3 ml of each of Solution B1 and Solution C1 were added to Solution A1 in 1.5 minutes at 42° C. by a double-jet method to form a nuclei.

After addition of Solutions B 1 and C 1 was stopped, the temperature of Solution A 1 was elevated to 60° C. spending 60 minutes and adjusted to pH 5.0 using a 3% KOH solution. Then, solutions B 1 and C-1 each were added by means of a double jet method for 42 minutes at a flow rate of 55.4 ml/min. The silver potentials (measured by means of a silver ion selecting electrode and a saturated silver-silver chloride reference electrode) during the temperature elevation from 42° to 60° C. and during the re-addition of solutions B-1 and C-1 were regulated to +8 mv and 16 mv, respectively, using Solution D 1.

After the addition, pH was regulated to 6 with 3% KOH. Immediately after that, it was subjected to desalting and washing. It was observed by an electron microscope that this seed emulsion was composed of hexahedral tabular grains, in which 90% or more of the total projected area of silver halide grains have a maximum adjacent side ratio of 1.0 to 2.0, having an average thickness of 0.064 μm, an average diameter (converted to a circle) of 0.595 μm. The deviation coefficient of the thickness is 40%, and the deviation coefficient of the distance between the twin planes is 42%.

(Preparation of Emulsion Em-1)

The tabular silver bromide emulsion Em-1 was prepared using the seed emulsion 1 and the following four kinds of solutions.

| | |
|---|---|
| A2 | |
| Ossein gelatin | 34.03 g |
| Polypropyleneoxy-polyethyleneoxy-disuccinate sodium salt (10% ethanol solution) | 2.25 ml |
| Seed emulsion 1 | amount equivalent to 1.218 mol |
| Water was added to make 3150 ml. | |
| B2 | |
| Potassium bromide | 1747 g |
| Water was added to make 3669 ml. | |
| C2 | |
| Silver nitrate | 2493 g |

Solution B2 and Solution C2 were added to Solution A2 in 100 minutes at 60° C. by a double-jet method with vigorous stirring. During this process, pH was maintained 5.8, and pAg 8.8. Herein, the addition rate of solutions B 2 and C 2 was varied as a function of time to meet a critical grain growing rate. That is, the addition was carried out at an appropriate addition rate not to produce small grains other than the seed grains and not to cause polydispersion due to Ostwald ripening.

After the addition, the resulting emulsion was cooled to 40° C., added with 1800 ml of an aqueous 13.8 weight % solution of modified gelatin as a polymer coagulant, which was modified with phenylcarbamoyl (substitution rate of 90%), and stirred for 3 minutes. Thereafter, a 56 weight % acetic acid solution was added to give a pH of 4.6, stirred for 3 minutes, allowed to stand for 20 minutes, and then the supernant was decanted. Thereafter, 9.0 liter of 40° C. distilled water were added, stirred, allowed to stand, and the supernant was decanted. To the resulting emulsion were added 11.25 liter of distilled water, stirred, allowed to stand, and the supernant was decanted. An aqueous gelatin solution and a 10 weight % sodium carbonate solution were added to the resulting emulsion to be pH of 5.8, and stirred at 50° C. for 30 minutes to redisperse.

After the redispersion, the emulsion was adjusted to give pH of 5.80 and pAg of 8.06. When the resulting emulsion was observed by means of an electron microscope, they were tabular silver halide grains having an average diameter of 1.11 μm, an average thickness of 0.25 μm, an average aspect ratio of about 4.5 and a grain size distribution of 18.1%. The average twin plane distance (a) was 0.020 μm, and variation coefficient of (a) was 32%.

After the resulting emulsion was raised to 60° C., a sensitizing dye was added in a given amount in a solid fine particle dispersion, and then adenine, ammonium thiocyanate and sensitizers were added. Sixty minutes after the addition, the fine grain silver iodide emulsion was added, and the emulsion was ripened for total 2 hours.

After completion of the chemical ripening, 4-hydroxy-6-methyl-1.3.3a.7-tetrazaindene (TAI) as a stabilizer was added in a given amount.

The addition amount per mol of AgX of the above additives is shown as follows.

| | |
|---|---|
| Spectral sensitizing dye (SD-11) | 2.0 mg |
| Spectral sensitizing dye (SD-12) | 120 mg |
| Adenine | 15 mg |

-continued

| | |
|---|---|
| Ammonium thiocyanide | 95 mg |
| Sensitizers | |
| Water-soluble gold compound ($HAuCl_4 \cdot 4\ H_2O$) | $6.5 \times 10^{-6}$ mol/mol Ag |
| Unstable sulfur compound ($Na_2S_2O_3 \cdot 5\ H_2O$) | $8.1 \times 10^{-6}$ mol/mol Ag |
| Selenium compound ($Ph_3P{=}Se$) | $8.1 \times 10^{-6}$ mol/mol Ag |
| Silver iodide fine grain emulsion | 280 mg |
| 4-Hydroxy-6-methyl-1.3.3a.7-tetrazaindene | 50 mg |

SD-11

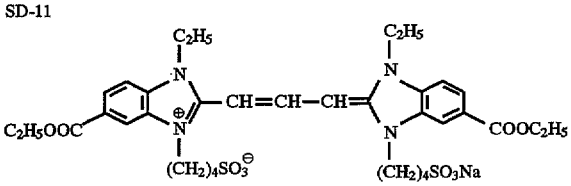

SD-12

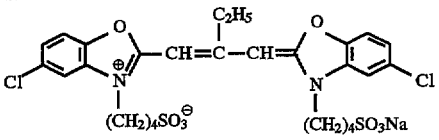

The solid fine particle dispersions of the spectral sensitizing dyes were prepared in a similar manner as a method described in Japanese Patent Application No. 4-99437/1996. The dispersion were obtained by adding the sensitizing dye in a given amount to 27° C. water and then stirring the mixture at 3.500 rpm for 30 to 120 minutes with a high speed stirrer (dissolver).

The silver halide grains contained in the above obtained silver halide emulsion (Em-1) had an average silver iodide content of 4 mol % on its surface. To the thus sensitized emulsion were added the following additives to obtain an emulsion layer coating solution. Further, a protective layer coating solution was prepared.

As a support was used a blue colored 175 μm thick polyethylene terephthalate film (a density of 0.15) for X-ray film, both sides of which were coated with an aqueous dispersion containing 10 wt % of a copolymer of glycidylmethacrylate, methyl acrylate and butyl acrylate (50:10:49, weight ratio) to give a subbing layer.

The following dye layer was coated on both sides of the support, and the above emulsion layer coating solution and protective layer coating solution were double layer coated in that order on each side of the support (a density of 0.15) by means of two slide hopper coaters and dried. Thus, silver halide photographic light sensitive material samples I-F through I-J, II-F through II-J and III-F through III-J were prepared.

| | |
|---|---|
| **First Layer (Dye Layer)** | |
| Solid dye fine particle dispersion (AH) | 180 mg/m² |
| Gelatin | 0.2 g/m² |
| Sodium dodecylbenzene sulfonate | 5 mg/m² |
| Latex (L) | 0.2 g/m² |
| Colloidal Silica (average diameter 0.014 μm) | 10 mg/m² |
| **Second Layer (Emulsion Layer)** | |
| Emulsion Em-1 obtained above was added with the following additives. | |
| Compound (ST-2) | 0.5 mg/m² |
| 2,6-Bis(hydroxyamino)-4-diethylamino-1,3,5-triazine | 5 mg/m² |
| t-Butyl-catechol | 130 g/m² |

-continued

| | |
|---|---|
| Polyvinyl pyrroridone (molecular weight 10,000) | 35 mg/m² |
| Styrene-maleic acid anhydride copolymer | 80 mg/m² |
| Poly(sodium styrenesulfonate) | 80 mg/m² |
| Trimethylolpropane | 350 mg/m² |
| Diethylene glycol | 50 mg/m² |
| Nitrophenyl-triphenyl phosphonium chloride | 20 mg/m² |
| Ammonium 1,3-dihydroxybenzene-4-sulfonic acid | 500 mg/m² |
| 2-Mercaptobenzimidazole-5-sodiumsulfonate | 5 mg/m² |
| Compound (HS-2) | 0.5 mg/m² |
| $n\text{-}C_4H_9OCH_2CH(OH)CH_2N(CH_2COOH)_2$ | 350 mg/m² |
| Compound (ST-3) | 5 mg/m² |
| Compound (HS-4) | 0.2 mg/m² |
| Compound (ST-5) | 5 mg/m² |
| Compound (ST-6) | 0.2 mg/m² |
| Collodal Silica (particle size not more than 0.3 μm) | 0.5 g/m² |
| Latex (L) | 0.2 g/m² |
| Dextrin (average molecular weight 1000) | 0.2 g/m² |
| 5-methylbenzotriazole | 0.7 mg/m² |
| Gelatin | 1.0 g/m² |
| **Third Layer (Protective Layer)** | |
| Gelatin | 0.8 mg/m² |
| 4-Hydroxy-6-methyl-1.3.3a.7-tetrazaindene | 20 mg/m² |
| Polymethylmethacrylate matting agent (having an area average grain size of 7.0 μm) | 50 mg/m² |
| Latex (L) | 0.2 g/m² |
| Polyacrylamide (molecular weight 10,000) | 0.1 g/m² |
| Polysodium acrylate | 30 mg/m² |
| Polysiloxane (HS-3) | 20 mg/m² |
| Compound (SA-1) | 12 mg/m² |
| Compound (SA-2) | 2 mg/m² |
| Compound (SA-3) | 7 mg/m² |
| Compound (HS-4) | 15 mg/m² |
| Compound (SA-4) | 15 mg/m² |
| Compound (SA-4) | 50 mg/m² |
| Comoound (SA-5) | 5 mg/m² |
| $C_9H_{19}-O-(CH_2CH_2O)_{11}-H$ | 3 mg/m² |
| $(C_8F_{17}SO_2)(C_3H_7)N(CH_2CH_2O)_{15}H$ | 2 mg/m² |
| $(C_8F_{17}SO_2)(C_3H_7)N(HC_2CH_2O)_4-(CH_2)_4SO_3Na$ | 1 mg/m² |

Compound ST-2

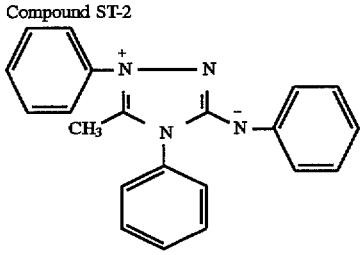

Compound HS-2

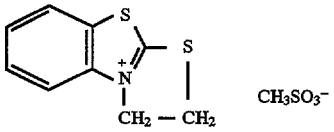

CompoundSA-1

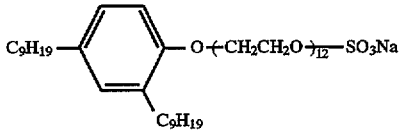

Compound SA-2

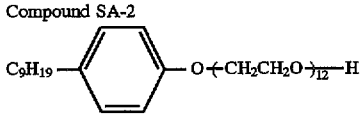

-continued

Compound HS-4

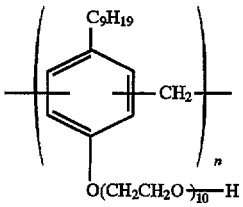

(a mixture of n = 2 to 5)

Latex (L)

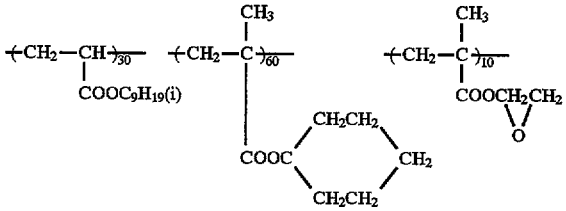

Polysiloxane (HS-3)

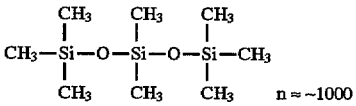

Solid fine particle dispersion dye (F-3)

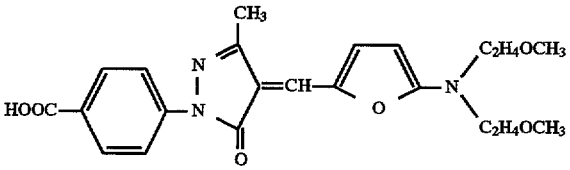

Compound (SA-3)

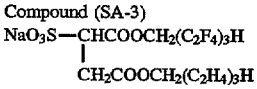

Compound (SA-4)

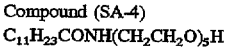

Compound (SA-5)

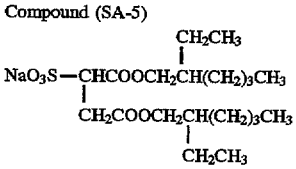

Compound (ST-3)

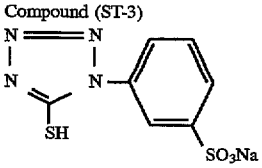

Compound (ST-4)

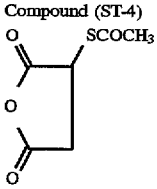

-continued

Compound (ST-5)

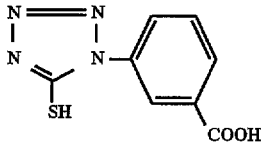

Compound (ST-6)

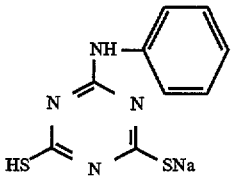

Antiseptic agent DI-1 was added to each sample above. Inventive hardeners and comparative hardener were added to the protective layer immediately before coating. The addition amount of the hardeners is an amount based on the total gelatin amount (the sum of gelatin added to First layer, second layer and third layer) which is shown in Table 3.

The amount was per one side of the support, and the silver amount was 1.6 g/m$^2$ per one side of the support.

The above obtained samples were fresh samples, and the samples were further stored at 50° C. and 50% RH for three days.

The evaluation was carried out as follows:

Each sample was sandwiched between two intensifying screens KO-250 (produced by Konica Corporation), and exposed to X-ray through alminum wedge at a tube potential of 80 kvp and at a tube current of 100 mA for 0.05 seconds. The resulting sample was processed using the following developer and fixer in an automatic processor SRX-502 (produced by Konica Corporation).

| | |
|---|---|
| Developer composition | |
| Part A (for 12 liter) | |
| Potassium hydroxide | 450 g |
| Potassium sulfite (50% solution) | 2280 g |
| Diethylene tetramine pentaacetate | 120 g |
| Sodium bicarbonate | 132 g |
| 5-Methylbenzotriazole | 1.2 g |
| 1-Phenyl-5-mercaptotetrazole | 0.2 g |
| Hydroquinone | 340 g |
| Water added to 5000 ml. | |
| Part B (for 12 liter) | |
| Glacial acetic acid | 170 g |
| Triethylene glycol | 185 g |
| 1-Phenyl-3-pyrazolidone | 22 g |
| 5-Nitroindazole | 0.4 g |
| Starter | |
| Glacial acetic acid | 120 g |
| Potassium bromide | 225 g |
| Water added to 1.0 liter. | |
| Fixer composition | |
| Part A (for 18 liter) | |
| Ammonium thiosulfate (70 wt/vo %) | 6000 g |
| Sodium sulfite | 110 g |
| water acetate.pentahydrate | 450 g |
| Sodium citrate | 50 g |

-continued

| | |
|---|---|
| Gluconic acid | 70 g |
| 1-(N,N-dimethylamino)ethyl-5-mercaptotetrazole | 18 g |
| Part B (for 18 liter) | |
| Aluminum sulfate | 800 g |

Parts A and B were incorporated in 5 liter water while stirring and water was added to make 12 liter. The resulting developer was adjusted to pH 10.40 with glacial acetic acid. Thus, Developer was prepared.

Separate portions of the fresh samples were stored at 50° C. and 50% RH for 3 hours, 2 days and 3 days, and each portion was then immersed in 30° C. water for 5 minutes. A sapphire needle having a radius of 0.3 mm was brought into pressure contact with the surface of the resulting three samples and moved at a rate of 2 mm/second while applying load continuously varying from 0 to 200 g. Thus, the load at which the surface of the samples was first damaged was designated as surface strength.

The results are shown in Table 3.

TABLE 3

| Sample | Hardener | | Photographic properties | | Hardening property Surface strength (g) | | |
|---|---|---|---|---|---|---|---|
| | | Addition amount mmol/100 g of | Forced aging conditions 3 days (50° C., 50% RH) | | | | |
| No. | Kinds | gelatin | Sensitivity | Fog | 3 hrs | 2 days | 3 days |
| I-F (INV.) | I-4 | 10 | 100 | 0.04 | 50 | 56 | 56 |
| I-G (INV.) | I-5 | 10 | 100 | 0.04 | 49 | 55 | 55 |
| I-H (INV.) | I-7 | 10 | 101 | 0.04 | 51 | 57 | 57 |
| I-I (INV.) | I-8 | 10 | 98 | 0.04 | 48 | 54 | 54 |
| I-J (INV.) | I-11 | 10 | 100 | 0.04 | 50 | 56 | 56 |
| II-F (INV.) | II-4 | 10 | 100 | 0.04 | 52 | 58 | 58 |
| II-G (INV.) | II-5 | 10 | 99 | 0.04 | 49 | 55 | 55 |
| II-H (INV.) | II-7 | 10 | 100 | 0.04 | 52 | 57 | 57 |
| II-I (INV.) | II-8 | 10 | 99 | 0.04 | 51 | 56 | 56 |
| II-J (INV.) | II-11 | 10 | 99 | 0.04 | 53 | 58 | 58 |
| III-F (INV.) | III-2 | 10 | 100 | 0.04 | 50 | 55 | 55 |
| III-G (INV.) | III-3 | 10 | 101 | 0.04 | 52 | 56 | 56 |
| III-H (INV.) | III-4 | 10 | 99 | 0.04 | 53 | 58 | 58 |
| III-I (INV.) | III-5 | 10 | 100 | 0.04 | 51 | 57 | 57 |
| III-J (INV.) | III-7 | 10 | 99 | 0.04 | 52 | 57 | 57 |
| IV-B (Comp.) | Comparative compound (1) | 10 | 96 | 0.06 | 37 | 40 | 46 |

To 1 liter of the developer were added 20 ml/liter of the starter described above and pH was adjusted to 10.40. Thus, developer to be used was obtained.

In preparing fixer, Parts A and B of the fixer composition were incorporated in 5 liter water while stirring and water was added to make 18 liter. The resulting fixer was adjusted to pH 4.4 with surfuric acid and NaOH. Thus, fixer replenisher was prepared.

Regarding processing temperatures, development temperature was 35° C., fixing temperature was 33° C., washing temperature was 20° C., and drying temperature was 50° C. The total processing time was 45 seconds in dry to dry time.

After the processing, sensitivity was measured. Sensitivity was represented by a reciprocal of exposure necessary to give a density of fog plus 0.5, and sensitivity of samples was represented in terms of sensitivity relative to sensitivity of Sample No. I-F stored at 50° C. and 50% RH for three days after coating being defined as 100.

As is apparent from Table 3, Samples I-F through II-J, II-F through II-J and III-F through III-J, which employ the hardener of the invention, minimize fog increase and sensitivity lowering under the forced aging conditions. Accordingly, the hardener of the invention has no adverse affect on the photographic properties.

As is seen from the test results of the hardening property, the surface strength of Samples I-F through II-J, II-F through II-J and III-F through III-J does not vary after the two day or more storage, but Comparative sample IV-B does. Accordingly, the hardener of the invention has no after-hardening property.

What is claimed is:

1. A method for hardening gelatin comprising mixing gelatin with a compound represented by the following formula (I), (II) or (III):

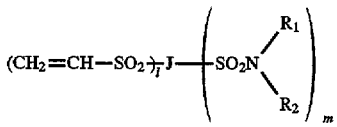

formula (I)

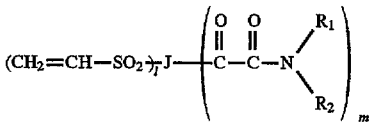

formula (II)

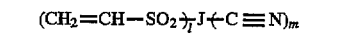

formula (III)

wherein $R_1$ and $R_2$ independently represent a hydrogen atom, an alkyl group, an aryl group or a heterocyclic group or $R_1$ and $R_2$ combine with each other to form a nitrogen-containing heterocyclic ring; J represents an alkylene group, a phenylene group, a heterocyclic group or an alkylene group having, in the main chain of the alkylene group another organic divalent group selected from the group consisting of —O—, —S—, —(C=O)—, —$SO_2$—, —(C=O)NR— and —NR— in which R represents hydrogen or alkyl; 1 represents an integer of 2 to 5; and m represents an integer of 1 to 5.

2. The method of claim 1, wherein said formula (I) is represented by the following formula (IV), said formula (II) is represented by the following formula (V), and said formula (III) is represented by the following formula (VI):

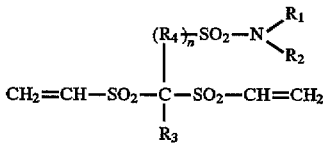

formula (IV)

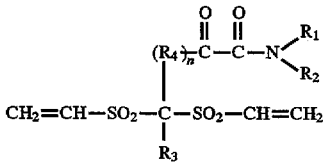

formula (V)

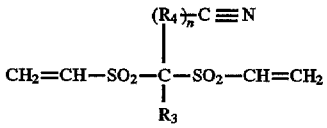

formula (VI)

wherein $R_1$ and $R_2$ independently represent a hydrogen atom, an alkyl group, an aryl group or a heterocyclic group or $R_1$ and $R_2$ combine with each other to form a nitrogen-containing heterocyclic ring; $R_3$ represents a hydrogen atom, an alkyl group, an alkenyl group, an alkinyl group, an aryl group, a heterocyclic group, a halogen atom, an alkoxy group, an aryloxy group, an alkoxycarbonyl group, an aryloxycarbonyl group, a sulfonylamino group, a sulfamoyl group, a ureido group, an acyl group, a carbamoyl group, an amido group, a sulfonyl group, an amino group, a cyano group, a nitro group, a sulfo group, a carboxy group, a hydroxy group or an oxamoyl group; $R_4$ represents an alkylene group; and n represents an integer of 0 or 1.

3. The method of claim 1, wherein said 1 is 2; and said m is 1 or 2.

4. The method of claim 1, wherein J represents an alkylene group or an alkylene group having, in the main chain of the alkylene group another organic divalent group selected from the group consisting of —O—, —S—, —(C=O)—, —$SO_2$—, —(C=O)NR— and —NR— in which R represents hydrogen or alkyl.

5. The method of claim 4, wherein said 1 is 2; and said m is 1 or 2.

6. The method of claim 1, wherein said compound represented by said formula (I), (II) or (III) is mixed with gelatin in an amount of 0.03 to 1.0 mmol per 1 g of the gelatin weight.

7. The method of claim 1, wherein said compound represented by said formula (I), (II) or (III) is mixed with gelatin in an amount of 0.01 to 2.0 mmol per 1 g of the gelatin weight.

8. The method of claim 1, wherein said compound represented by said formula (I), (II) or (III) is selected from the group consisting of

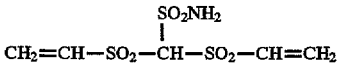

I-1

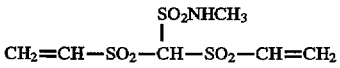

I-2

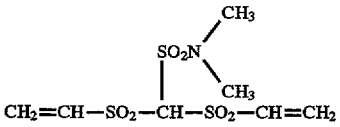

I-3

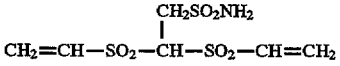

I-4

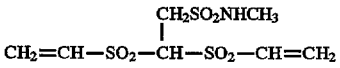

I-5

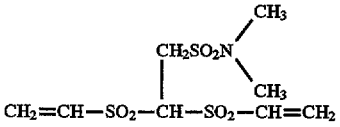

I-6

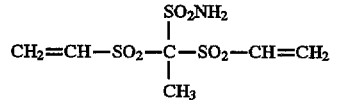

I-7

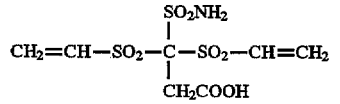

I-8

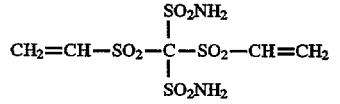

I-9

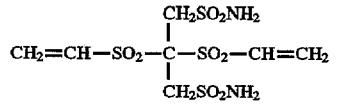

I-10

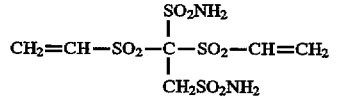

I-11

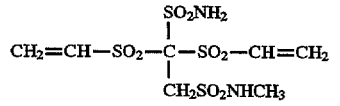

I-12

-continued
I-13
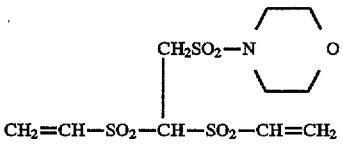
I-14
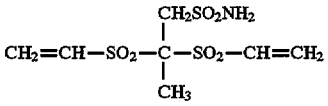
I-15
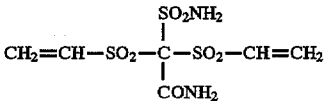
I-16
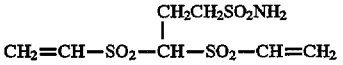
I-17
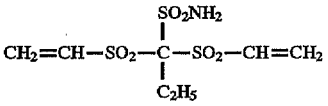
I-18
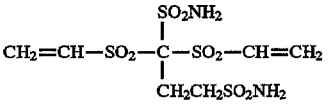
I-19
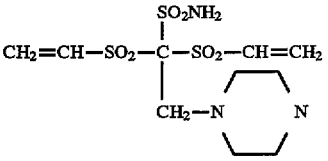
I-20
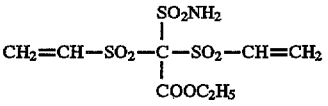
I-21
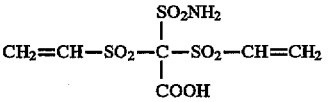
I-22
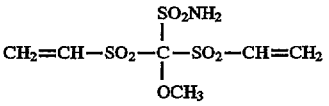
I-23
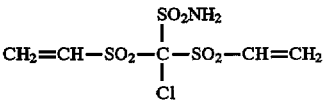
I-24
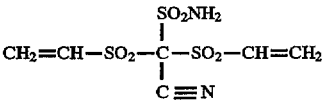
I-25
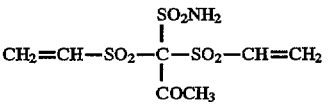
-continued
I-26
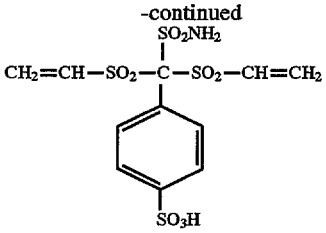
I-27
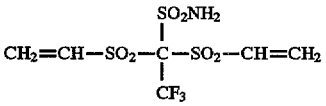
I-28
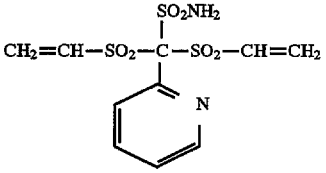
I-29
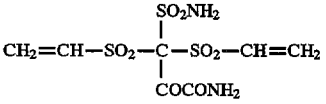
I-30
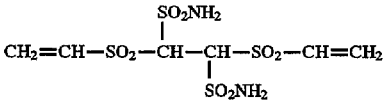
I-31
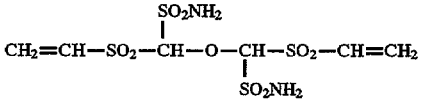
I-32
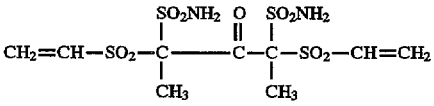
I-33
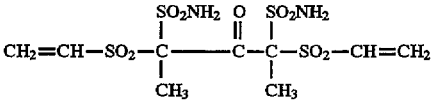
I-34
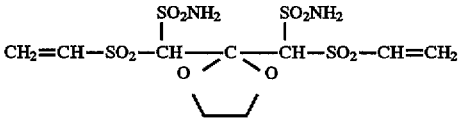
I-35
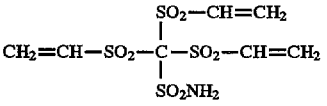
I-36
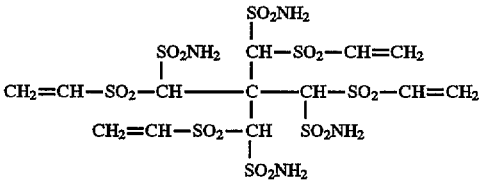
I-37
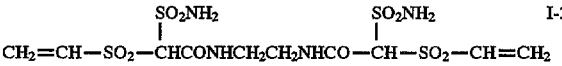

-continued
II-1
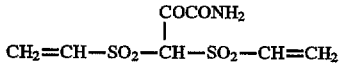
II-2
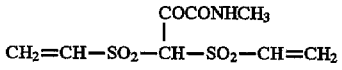
II-3
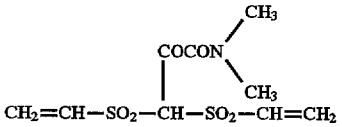
II-4
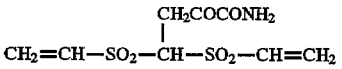
II-5
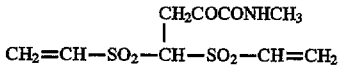
II-6
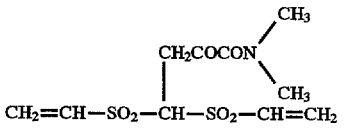
II-7
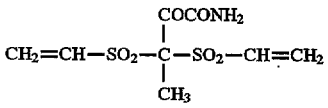
II-8
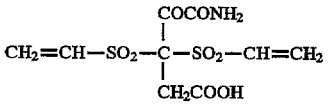
II-9
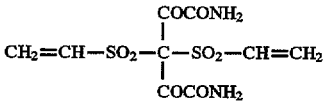
II-10
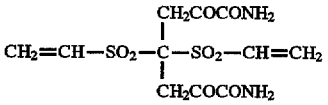
II-11
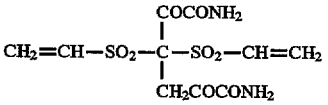
II-12
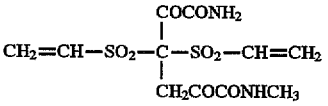
II-13
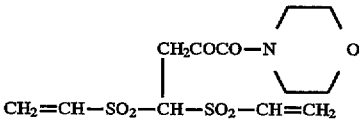
II-14
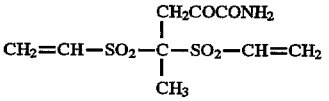
II-15
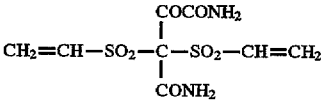
-continued
II-16
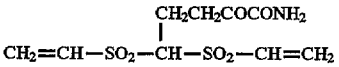
II-17
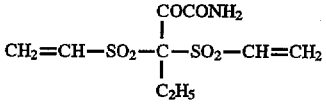
II-18
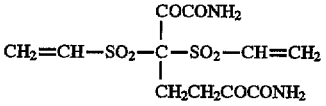
II-19
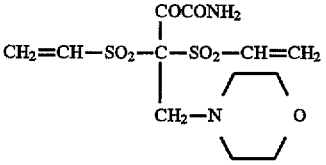
II-20
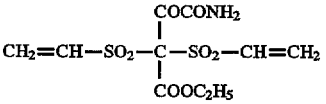
II-21
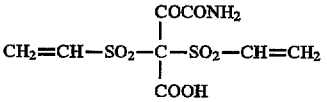
II-22
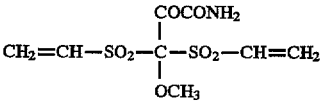
II-23
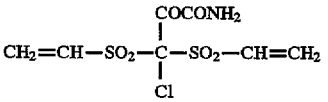
II-24
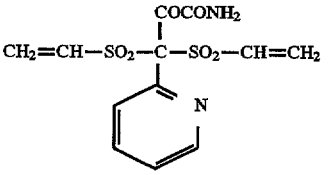
II-25
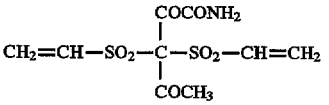
II-26
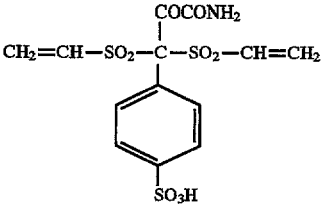
II-27
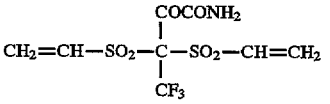

-continued
II-28
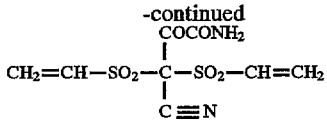
II-29
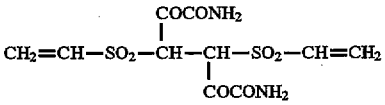
II-30
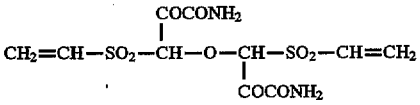
II-31
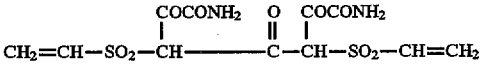
II-32
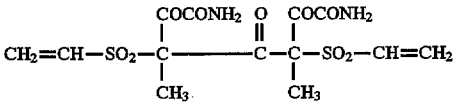
II-33
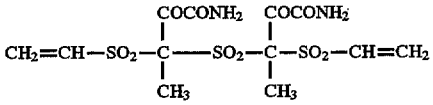
II-34
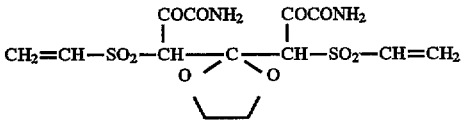
II-35
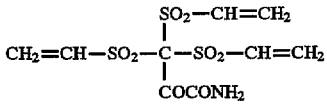
II-36
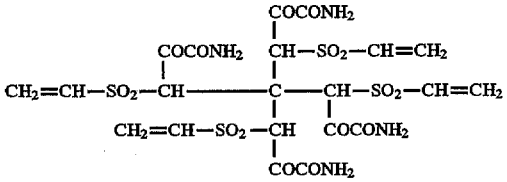
II-37
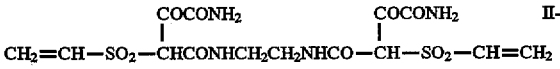
III-1
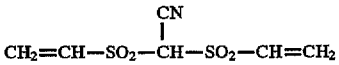
III-2
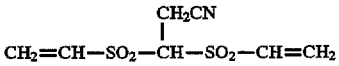
III-3
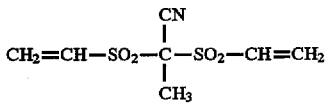
III-4
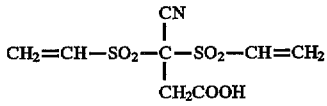
III-5
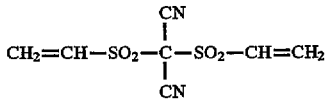
-continued
III-6
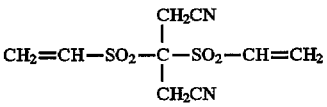
III-7
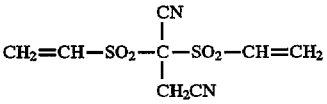
III-8
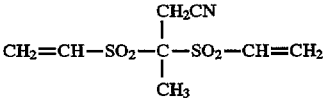
III-9
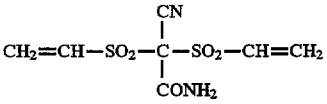
III-10
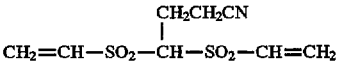
III-11
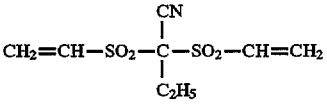
III-12
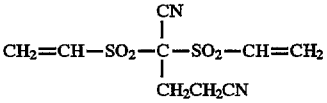
III-13
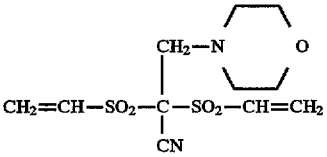
III-14
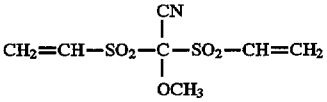
III-15
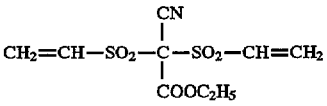
III-16
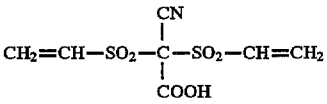
III-17
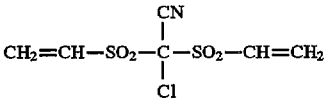
III-18
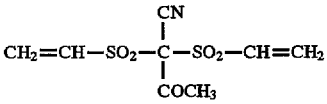

-continued
III-19
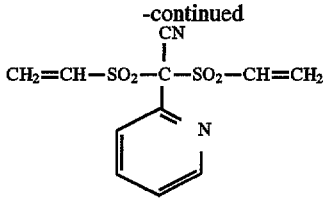
III-20
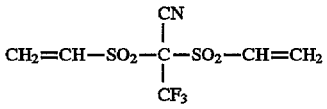
III-21
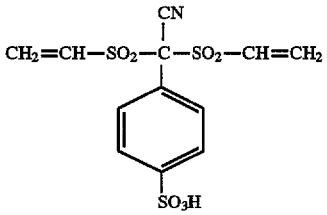
III-22
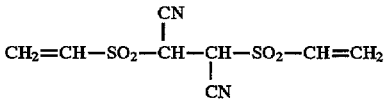
III-23
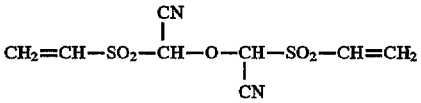
III-24
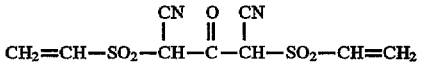
III-25
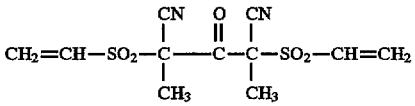
III-26
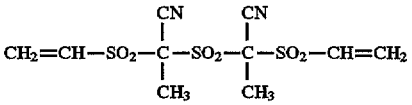
-continued
III-27
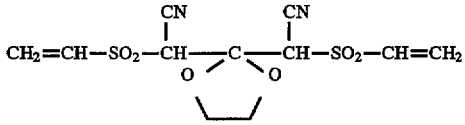
III-28
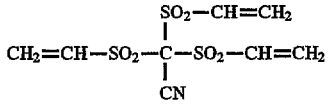
III-29
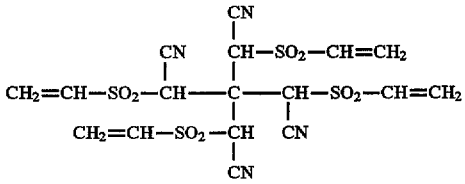
and
III-30
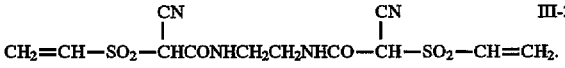
9. The method of claim 8, wherein said compound is mixed in an amount of 0.01 to 2.0 millimol per gram of gelatin.
10. The method of claim 7, wherein said compound represented by said formula (I), (II) or (III) is mixed with gelatin in an amount of 0.03 to 2.0 mmol per 1 g of the gelatin weight.
* * * * *